US008571717B2

(12) United States Patent
Nishino et al.

(10) Patent No.: US 8,571,717 B2
(45) Date of Patent: Oct. 29, 2013

(54) GROUP MANAGEMENT APPARATUS AND GROUP MANAGEMENT SYSTEM

(75) Inventors: Atsushi Nishino, Kusatsu (JP); Satoshi Hashimoto, Sakai (JP); Toshiyuki Miki, Kusatsu (JP); Shigesada Omoto, Kusatsu (JP); Takashige Kai, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 361 days.

(21) Appl. No.: 13/054,827

(22) PCT Filed: Jul. 16, 2009

(86) PCT No.: PCT/JP2009/003362

§ 371 (c)(1),
(2), (4) Date: Jan. 19, 2011

(87) PCT Pub. No.: WO2010/010676

PCT Pub. Date: Jan. 28, 2010

(65) Prior Publication Data

US 2011/0130880 A1 Jun. 2, 2011

(30) Foreign Application Priority Data

Jul. 23, 2008 (JP) ..... 2008-190335

(51) Int. Cl.

| | |
|---|---|
| ***G05B 13/00*** | (2006.01) |
| ***G05B 15/00*** | (2006.01) |
| ***G05D 23/00*** | (2006.01) |
| ***F24F 11/00*** | (2006.01) |

(52) U.S. Cl.

CPC ..... *F24F 11/0086* (2013.01); *F24F 11/0012* (2013.01)

USPC ..... 700/277; 700/276; 700/299; 700/300; 236/49.3; 236/44 C; 709/223

(58) Field of Classification Search

USPC ..... 700/276

See application file for complete search history.

(56) References Cited

U.S. PATENT DOCUMENTS 4,187,543 A * 2/1980 Healey et al. ..... 700/277
4,205,381 A * 5/1980 Games et al. ..... 700/277

(Continued)

FOREIGN PATENT DOCUMENTS

JP 54129826 A * 10/1979
JP 56076849 A * 6/1981

(Continued)

OTHER PUBLICATIONS

Carrier Corporation, "United Technologies Carrier Corporation—Remote Monitoring", 2002, Retrieved online Mar. 1, 2013 at "www.carrier-commercial.com".*

(Continued)

*Primary Examiner* — Mohammad Ali
*Assistant Examiner* — Kelvin Booker
(74) *Attorney, Agent, or Firm* — Global IP Counselors

(57) ABSTRACT

A group management apparatus is configured to manage a plurality of air conditioning facilities installed in a plurality of buildings as a plurality of groups. The group management apparatus includes an obtaining section configured to obtain operational data of the air conditioning facilities through a plurality of control units disposed in the buildings on a one-to-one basis, and an extracting section configured to extract one or more groups satisfying predetermined conditions from the groups based on a plurality of assessment perspectives. The control units are configured to control the air conditioning facilities within the buildings. A group management system includes the group management apparatus and the control units.

11 Claims, 15 Drawing Sheets

(56) References Cited

U.S. PATENT DOCUMENTS

| | | | | |
|---|---|---|---|---|
| 4,215,408 | A * | 7/1980 | Games et al. | 700/278 |
| 4,497,031 | A * | 1/1985 | Froehling et al. | 700/276 |
| 6,349,883 | B1 * | 2/2002 | Simmons et al. | 236/46 R |
| 6,842,668 | B2 * | 1/2005 | Carson et al. | 700/286 |
| 6,967,565 | B2 * | 11/2005 | Lingemann | 700/276 |
| 7,082,353 | B2 * | 7/2006 | Kwon et al. | 700/277 |
| 7,130,719 | B2 * | 10/2006 | Ehlers et al. | 700/276 |
| 7,343,226 | B2 * | 3/2008 | Ehlers et al. | 700/276 |
| 7,379,997 | B2 * | 5/2008 | Ehlers et al. | 709/224 |
| 7,418,428 | B2 * | 8/2008 | Ehlers et al. | 705/63 |
| 7,460,930 | B1 * | 12/2008 | Howell et al. | 700/295 |
| 7,516,106 | B2 * | 4/2009 | Ehlers et al. | 705/412 |
| 7,532,950 | B2 * | 5/2009 | Cha et al. | 700/277 |
| 7,734,572 | B2 * | 6/2010 | Wiemeyer et al. | 700/19 |
| 7,814,756 | B2 * | 10/2010 | Masui | 700/276 |
| 7,831,339 | B2 * | 11/2010 | Kim et al. | 700/276 |
| 7,900,849 | B2 * | 3/2011 | Barton et al. | 236/51 |
| 7,912,586 | B2 * | 3/2011 | Cha et al. | 700/277 |
| 7,949,615 | B2 * | 5/2011 | Ehlers et al. | 705/412 |
| 8,260,900 | B2 * | 9/2012 | Morrison et al. | 709/223 |
| 8,276,829 | B2 * | 10/2012 | Stoner et al. | 236/1 C |
| 2002/0152298 | A1 * | 10/2002 | Kikta et al. | 709/223 |
| 2002/0156750 | A1 * | 10/2002 | Kawamura et al. | 705/412 |
| 2004/0117330 | A1 * | 6/2004 | Ehlers et al. | 705/412 |
| 2004/0133314 | A1 * | 7/2004 | Ehlers et al. | 700/276 |
| 2004/0138981 | A1 * | 7/2004 | Ehlers et al. | 705/36 |
| 2004/0139038 | A1 * | 7/2004 | Ehlers et al. | 705/412 |
| 2005/0033707 | A1 * | 2/2005 | Ehlers et al. | 705/412 |
| 2005/0090915 | A1 * | 4/2005 | Geiwitz | 700/275 |
| 2006/0009863 | A1 * | 1/2006 | Lingemann | 700/276 |
| 2006/0149395 | A1 * | 7/2006 | Archacki et al. | 700/276 |
| 2006/0190138 | A1 * | 8/2006 | Stone et al. | 700/276 |
| 2006/0250578 | A1 * | 11/2006 | Pohl et al. | 351/210 |
| 2007/0043477 | A1 * | 2/2007 | Ehlers et al. | 700/276 |
| 2007/0043478 | A1 * | 2/2007 | Ehlers et al. | 700/276 |
| 2007/0069850 | A1 * | 3/2007 | Anderson et al. | 340/3.51 |
| 2007/0233323 | A1 * | 10/2007 | Wiemeyer et al. | 700/276 |
| 2008/0161977 | A1 * | 7/2008 | Takach et al. | 700/277 |
| 2008/0178615 | A1 * | 7/2008 | Yoon et al. | 700/276 |
| 2008/0185447 | A1 * | 8/2008 | Kim et al. | 700/276 |
| 2008/0188989 | A1 * | 8/2008 | Cha et al. | 700/277 |
| 2008/0217419 | A1 * | 9/2008 | Ehlers et al. | 236/44 C |
| 2008/0255782 | A1 * | 10/2008 | Bilac et al. | 702/62 |
| 2008/0277486 | A1 * | 11/2008 | Seem et al. | 236/49.3 |
| 2009/0140057 | A1 * | 6/2009 | Leen | 236/49.3 |
| 2009/0140058 | A1 * | 6/2009 | Koster et al. | 236/49.3 |
| 2009/0140059 | A1 * | 6/2009 | Barton et al. | 236/51 |
| 2009/0140060 | A1 * | 6/2009 | Stoner et al. | 236/51 |
| 2009/0140061 | A1 * | 6/2009 | Schultz et al. | 236/51 |
| 2009/0140063 | A1 * | 6/2009 | Koster et al. | 236/51 |
| 2009/0140064 | A1 * | 6/2009 | Schultz et al. | 236/51 |
| 2009/0157529 | A1 * | 6/2009 | Ehlers et al. | 705/26 |
| 2009/0271154 | A1 * | 10/2009 | Coad et al. | 703/1 |
| 2010/0241287 | A1 * | 9/2010 | Nishino et al. | 700/300 |
| 2010/0262299 | A1 * | 10/2010 | Cheung et al. | 700/278 |
| 2011/0061014 | A1 * | 3/2011 | Frader-Thompson et al. | 715/771 |
| 2011/0063126 | A1 * | 3/2011 | Kennedy et al. | 340/870.02 |
| 2011/0126144 | A1 * | 5/2011 | Sakaguchi et al. | 715/771 |
| 2011/0265974 | A1 * | 11/2011 | Maxwell | 165/58 |
| 2011/0307103 | A1 * | 12/2011 | Cheung et al. | 700/278 |
| 2012/0186774 | A1 * | 7/2012 | Matsuoka et al. | 165/11.1 |
| 2012/0192289 | A1 * | 7/2012 | Gazdzinski | 726/28 |
| 2012/0197647 | A1 * | 8/2012 | Gazdzinski | 704/275 |
| 2012/0197725 | A1 * | 8/2012 | Gazdzinski | 705/14.58 |
| 2012/0206362 | A1 * | 8/2012 | Gazdzinski | 345/168 |
| 2012/0239219 | A1 * | 9/2012 | Forbes, Jr. | 700/296 |
| 2013/0018486 | A1 * | 1/2013 | Bergman et al. | 700/17 |
| 2013/0024029 | A1 * | 1/2013 | Tran et al. | 700/278 |
| 2013/0090768 | A1 * | 4/2013 | Amundson et al. | 700/276 |

FOREIGN PATENT DOCUMENTS

| | | | |
|---|---|---|---|
| JP | 60233438 | A * | 11/1985 |
| JP | 62200128 | A * | 9/1987 |
| JP | 62280538 | A * | 12/1987 |
| JP | 05-324655 | A | 12/1993 |
| JP | 09-196444 | A | 7/1997 |
| JP | 9-236305 | A | 9/1997 |
| JP | 2003-216715 | A | 7/2003 |
| JP | 2008-075990 | A | 4/2008 |

OTHER PUBLICATIONS

Carrier Corporation, "Case Study—Doctors Hospital at Renaissence Women's Center", Apr. 2008, Retrieved online Mar. 1, 2013 at "www.carrier.com".*

Carrier Corporation, "Case Study—Morris Union", Feb. 2008, Retrieved online Mar. 1, 2013 at "www.carrier.com".*

International Search Report of corresponding PCT Application No. PCT/JP2009/003362.

International Preliminary Report of corresponding PCT Application No. PCT/JP2009/003362.

* cited by examiner

| PRIORITY RANK | AREA NAME | TROUBLE LEVEL | RESULT OF ENTIRE VALUE | RESULT OF INDIVIDUAL VALUE |
|---|---|---|---|---|
| 1 | BLDG. AA | 1. 0 | 1 | 1 |
| ... | ... | ... | ... | ... |
| 4 | BLDG. BB | 5. 0 | 7 | 3 |
| 5 | BLDG. CC | 6. 0 | 6 | 6 |

FIG. 8

GROUP MANAGEMENT APPARATUS AND GROUP MANAGEMENT SYSTEM

CROSS-REFERENCE TO RELATED APPLICATIONS

This U.S. National stage application claims priority under 35 U.S.C. §119(a) to Japanese Patent Application No. 2008-190335, filed in Japan on Jul. 23, 2008, the entire contents of which are hereby incorporated herein by reference.

TECHNICAL FIELD

The present invention relates to a group management apparatus.

BACKGROUND ART

A single control unit has been disposed in a single place within a building (e.g., a building occupied by companies or tenants) where a large number of air conditioning facilities is installed, and the air conditioning facilities are controlled by the control unit (see Japan Laid-open Patent Application Publication No. JP-A-H09-196444). Further, the control unit is configured to obtain operational data from the air conditioning facilities installed in the building and assess operational conditions of the air conditioning facilities for effectively managing the air conditioning facilities.

SUMMARY

Technical Problem

When a plurality of buildings is located in a single management region such as a hospital or a university, in contrast, a control unit is disposed in each of the buildings. In other words, a plurality of control units is disposed in a single management region. Further, operational conditions are assessed for the air conditioning facilities to be controlled by a corresponding control unit disposed in each building based on the information obtained by the corresponding control unit. Based on the assessment, a variety of actions are taken for efficiently controlling the air conditioning facilities.

However, it is a complicated and bothersome task to check the respective control units disposed in all the buildings for assessing the operational conditions of a large number of air conditioning facilities installed in all the buildings.

It is an object of the present invention to provide a group management apparatus or a group management system for efficiently assessing the operational conditions of a large number of air conditioning facilities installed in a plurality of buildings.

Solution to Problem

A group management apparatus according to a first aspect of the present invention is a group management apparatus configured to manage a large number of air conditioning facilities respectively installed in a plurality of buildings as a plurality of groups. The group management apparatus includes an obtaining section and an extracting section. The obtaining section is configured to obtain operational data of the large number of air conditioning facilities through a plurality of control units. The control units are disposed in the buildings on a one-to-one basis. The control units are configured to control the number of air conditioning facilities within the buildings. The extracting section is configured to extract one or more groups satisfying predetermined conditions from the groups based on a plurality of assessment perspectives.

According to the group management apparatus of the first aspect of the present invention, the operational data of the large number of air conditioning facilities to be controlled by the control units are obtained through the control units disposed in the buildings on a one-to-one basis. One or more groups satisfying the predetermined conditions are extracted from the groups based on the plural assessment perspectives. The term "group" herein refers to a group arbitrarily set by a user based on a basis of such as buildings, areas, types of the air conditioning facilities or the like.

It is thereby possible to efficiently assess the operational conditions of the large number of air conditioning facilities installed in the plural buildings.

A group management apparatus according to a second aspect of the present invention relates to the group management apparatus according to the first aspect of the present invention. In the group management apparatus, the assessment perspectives include at least one of energy consumption, long time operation, and reduction in comfort.

According to the group management apparatus of the second aspect of the present invention, the plural assessment perspectives include at least one of energy consumption, long time operation, and reduction in comfort.

It is thereby possible to assess one or more of the air conditioning facilities having any kind of trouble.

A group management apparatus according to a third aspect of the present invention relates to the group management apparatus according to one of the first and second aspects of the present invention. In the group management apparatus, the extracting section is configured to extract one or more groups satisfying the predetermined conditions from the groups based on a result of comparing an individual operational data of the air conditioning facilities belonging to a given one of the groups with an individual operational data of the air conditioning facilities belonging to another one of the groups and/or based on a result of comparing a group operational data of a given one of the groups with a group operational data of another of the groups. The term "group operational data" herein refers to an entire operational data of the air conditioning facilities belonging to a given one of the groups According to the group management apparatus of the third aspect of the present invention, an individual operational data of the air conditioning facilities belonging to a given one of the groups is compared with an individual operational data of the air conditioning facilities belonging to another one of the groups. Further or alternatively, an entire operational data of the air conditioning facilities belonging to a given one of the groups is compared with an entire operational data of the air conditioning facilities belonging to another one of the groups. Further, one or more groups satisfying predetermined conditions are configured to be extracted from the groups.

It is thereby possible to determine the operational data the air conditioning facilities belonging to the groups from various perspectives.

A group management apparatus according to a fourth aspect of the present invention relates to the group management apparatus according to the third aspect of the present invention. The group management apparatus further includes a screen generating section. The screen generating section is configured to generate screens respectively displaying a result extracted by the extracting section. The screen generating section is configured to generate a first screen and a second screen. The first screen displays a first result. The first result is the result extracted based on the result of comparing between the individual operational data. The second screen displays a second result. The second result is the result extracted based on the result of comparing between the group operational data.

According to the group management apparatus of the fourth aspect of the present invention, the screen displaying the result extracted based on the result of comparing between the individual operational data and the screen displaying the result extracted based on the result of comparing between the group operational data are generated.

It is thereby possible to refer to the extracted results depending on purposes.

A group management apparatus according to a fifth aspect of the present invention relates to the group management apparatus according to the fourth aspect of the present invention. The group management apparatus further includes an operational data storage area and a threshold value setting section. The operational data storage area is configured to store the operational data of the large number of air conditioning facilities. The threshold value setting section is configured to set a threshold value based on the operational data stored in the operational data storage area. The operational data and the threshold value are comparably displayed on the respective screens on an operational time basis.

According to the group management apparatus of the fifth aspect of the present invention, the operational data are stored, and the threshold value is set based on the stored operational data. Further, both of the operational data and the threshold value are comparably displayed on the screens based on an operational time basis.

It is thereby possible to easily specify one or more operational data greater than the threshold value.

A group management apparatus according to a sixth aspect of the present invention relates to the group management apparatus according to one of the third to fifth aspects of the present invention. In the group management apparatus, one or more groups satisfying the predetermined conditions are one or more of the air conditioning facilities having a trouble regarding one of the assessment perspectives. Further, the extracting section is configured to extract one or more groups having a trouble based on both of the result of comparing between the individual operational data and the result of comparing between the group operational data.

According to the group management apparatus of the sixth aspect of the present invention, one or more groups having a trouble are extracted from the groups based on both of the result of comparing between the individual operational data and the result of comparing between the group operational data.

It is thereby possible to further specifically determine one or more groups having a relatively serious trouble.

A group management apparatus according to a seventh aspect of the present invention relates to the group management apparatus according to one of the fourth to sixth aspects of the present invention. In the group management apparatus, the screen generating section is configured to generate a single screen switchably displaying said one or more groups extracted based on the respective assessment perspectives.

According to the group management apparatus of the seventh aspect of the present invention, a single screen is generated for switchably displaying one or more groups extracted based on the respective assessment perspectives.

It is thereby possible to easily check the assessments based on the plural assessment perspectives.

A group management system according to an eighth aspect of the present invention is a group management system configured to manage a large number of air conditioning facilities installed in a plurality of buildings as a plurality of groups. The group management system includes a plurality of control units and a group management apparatus. The control units are disposed in the buildings on a one-to-one basis. The control units are configured to control the large number of air conditioning facilities in the buildings. The group management apparatus is connected to the control units. The group management apparatus is configured to manage the large number of air conditioning facilities as a plurality of groups through the control units. Further, the group management apparatus includes an obtaining section and an extracting section. The obtaining section is configured to obtain a plurality of operational data of the large number of air conditioning facilities. The extracting section is configured to extract one or more groups satisfying predetermined conditions from the groups including the air conditioning facilities based on a plurality of assessment perspectives.

According to the group management system of the eighth aspect of the present invention, the operational data of the large number of air conditioning facilities controlled by the control units are obtained through the control units disposed in the buildings on a one-to-one basis. Further, one or more groups satisfying the predetermined conditions are extracted from the groups based on the plural assessment perspectives. The term "group" herein refers to a group arbitrarily set by a user on a basis of such as buildings, areas, types of the air conditioning facilities, or the like.

It is thereby possible to efficiently assess the operational conditions of the plural sets of the plural facility equipments installed in the plural buildings.

Advantageous Effects of Invention

According to the group management apparatus of the first aspect of the present invention, it is possible to efficiently assess the operational conditions of the large number of air conditioning facilities installed in the plural buildings.

According to the group management apparatus of the second aspect of the present invention, it is possible to assess one or more of the large number of air conditioning facilities having any kind of trouble.

According to the group management apparatus of the third aspect of the present invention, it is thereby possible to determine the operational data of the air conditioning facilities belonging to the plural groups from various perspectives.

According to the group management apparatus of the fourth aspect of the present invention, it is possible to refer to the extracted results depending on purposes.

According to the group management apparatus of the fifth aspect of the present invention, it is possible to easily specify one or more operational data greater than the threshold value.

According to the group management apparatus of the sixth aspect of the present invention, it is possible to further specifically determine one or more groups having a relatively serious trouble.

According to the group management apparatus of the seventh aspect of the present invention, it is possible to easily check assessments based on the plural assessment perspectives.

According to the group management system of the eighth aspect of the present invention, it is possible to efficiently assess the operational conditions of the large facility equipments installed in the plural buildings.

BRIEF DESCRIPTION OF THE DRAWINGS

FIG. 8 is a table representing an extraction condition adopted by a group management apparatus according to Modification (1) of the exemplary embodiment.

DESCRIPTION OF EMBODIMENTS

A group management system according to the present invention will be hereinafter explained with reference to figures.

<Entire Configuration>

Figure 1:
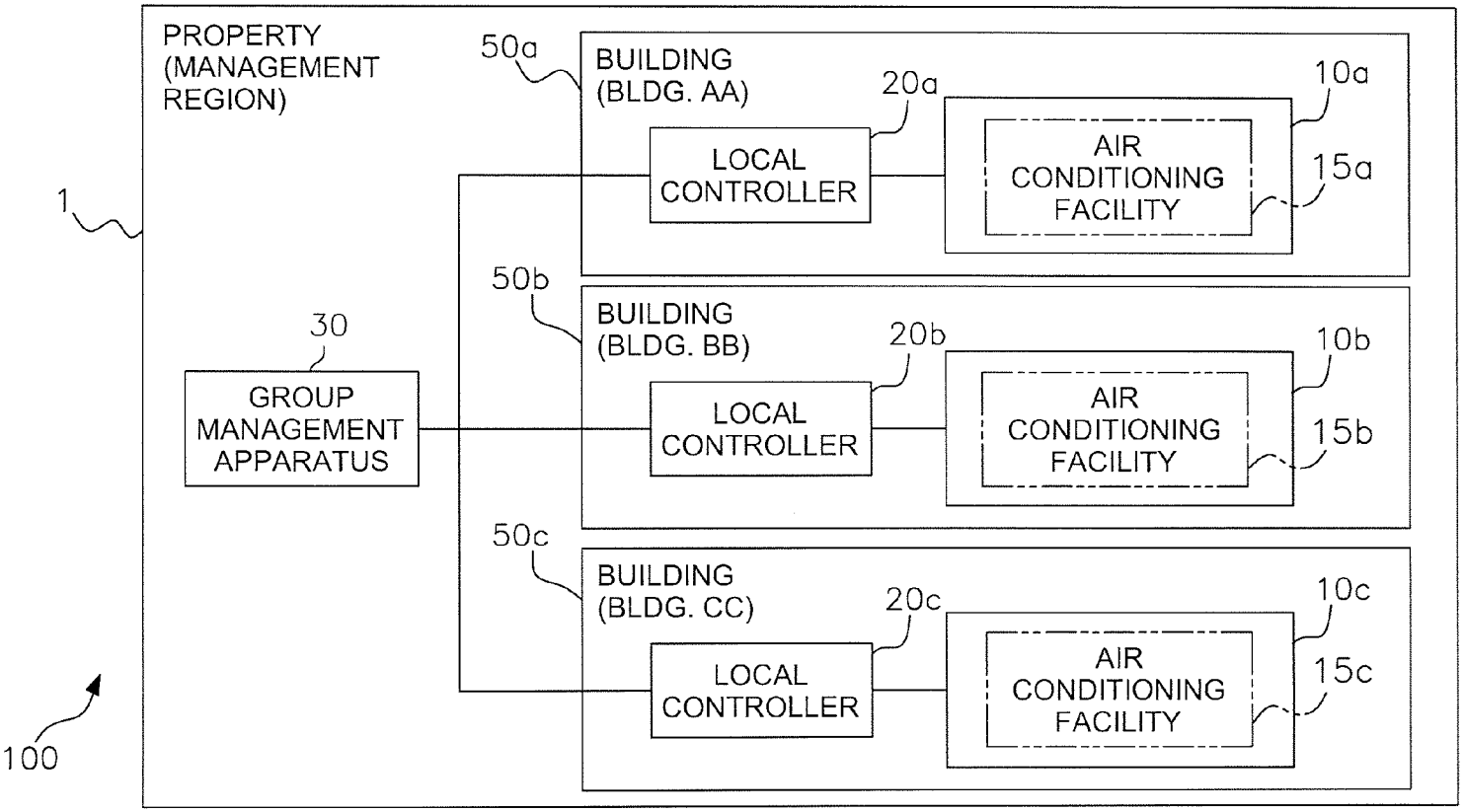
FIG. 1 is an entire configuration diagram of a group management system according to an exemplary embodiment of the present invention.

FIG. 1 illustrates a configuration of a group management system 100 of an exemplary embodiment of the present invention in a property 1. The group management system 100 is used for a property such as a university, a hospital or a factory where a plurality of buildings 50*a*, 50*b* and 50*c* is located in a single management region. The term "single management region" herein refers to a single closed region where establishments or buildings as management targets are owned by a single owner or a plurality of related owners. Further, the group management system 100 is configured to manage a large number of indoor units 12*aa*-12*ac*, 12*ba*-12*bc*, 12*ca*-12*cc* and the like (corresponding to "air conditioning facilities" in claims) included in the air conditioning facilities 10*a*, 10*b* and 10*c* within the buildings 50*a*, 50*b* and 50*c* as a plurality of indoor unit groups 15*a*, 15*b* and 15*c*. In the present exemplary embodiment, the plural indoor units 12*aa*-12*ac*, 12*ba*-12*bc*, 12*ca*-12*cc* and the like are managed as three indoor unit groups 15*a*, 15*b* and 15*c*. The indoor unit group 15*a* includes indoor units included in the air conditioning facility 10*a* within the building 50*a*. The indoor unit group 15*b* includes indoor units included in the air conditioning facility 10*b* within the building 50*b*. The indoor unit group 15*c* includes indoor units included in the air conditioning facility 10*c* within the building 50*c*.

The group management system 100 mainly includes the air conditioning facilities 10*a*, 10*b* and 10*c*, local controllers 20*a*, 20*b* and 20*c* (corresponding to "control units" in claims) and a group management apparatus 30. Each of the local controllers 20*a*, 20*b* and 20*c* is configured to control a corresponding one of the air conditioning facilities 10*a*, 10*b* and 10*c*. The group management apparatus 30 is connected to the plural local controllers 20*a*, 20*b* and 20*c*.

Figure 2:
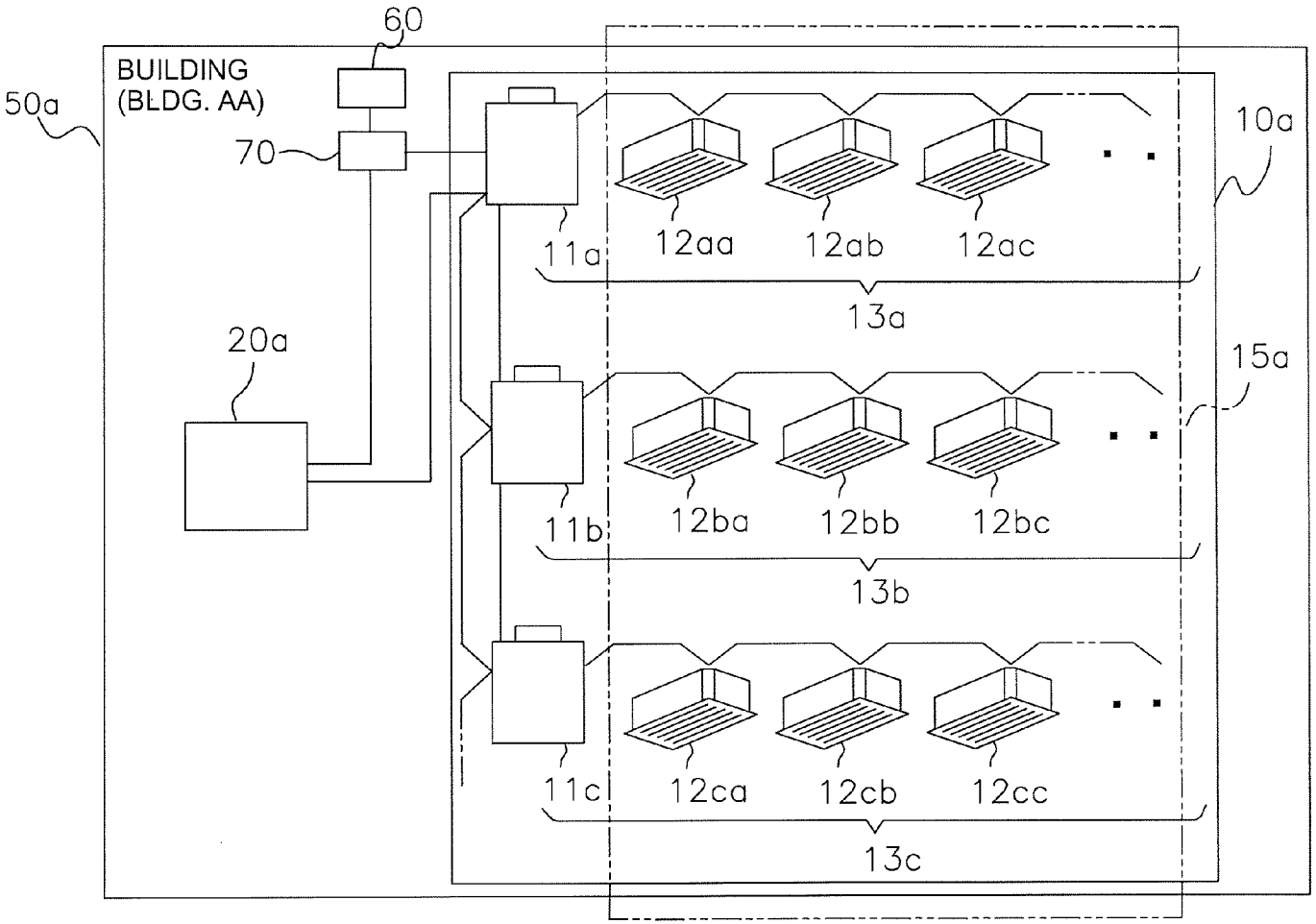
FIG. 2 is an internal configuration diagram of a building according to the exemplary embodiment.

FIG. 2 illustrates an internal configuration of the building 50*a* including the local controller 20*a* and the air conditioning facility 10*a*. The internal configurations of the other buildings 50*b* and 50*c* are herein the same as the internal configuration of the building 50*a*. The building 50*a* accommodates the local controller 20*a* and a plurality of air conditioners 13*a*, 13*b* and 13*c* as the air conditioning facility 10*a*. The air conditioners 13*a*, 13*b* and 13*c* are of the multi-installation type. Specifically, the air conditioner 13*a* includes an outdoor unit 11*a* and a plurality of indoor units 12*aa*, 12*ab*, 12*ac* and the like. The air conditioner 13*b* includes an outdoor unit 11*b* and a plurality of indoor units 12*ba*, 12*bb*, 12*bc* and the like. The air conditioner 13*c* includes an outdoor unit 11*c* and a plurality of indoor units 12*ca*, 12*cb*, 12*cc* and the like. The outdoor units 11*a*, 11*b*, 11*c* and the like are connected to a power supply 60. Electric power is supplied to the air conditioners 13*a*, 13*b* and 13*c* from the power supply 60 through a power supply line. Electric power to be supplied to the air conditioners 13*a*, 13*b* and 13*c* (i.e., total power consumption) is measured by a wattmeter 70 provided on the power supply line connecting the power supply 60 and the outdoor units 11*a*, 11*b*, 11*c* and the like.

The group management apparatus 30 is located in the management region and is connected to the plural local controllers 20*a*, 20*b* and 20*c* installed in the respective buildings 50*a*, 50*b* and 50*c* through a local area network (hereinafter referred to as LAN).

The group management system 100 of the present exemplary embodiment is configured to centrally control all the indoor units 12*aa*-12*ac*, 12*ba*-12*bc*, 12*ca*-12*cc* and the like installed in each of the buildings using the corresponding one of the local controllers 20*a*, 20*b* and 20*c*. Further, the group management system 100 is configured to manage the large number of the indoor units 12*aa*-12*ac*, 12*ba*-12*bc*, 12*ca*-12*cc* and the like installed in the respective buildings within the management region 1 as the plural indoor unit groups 15*a*, 15*b* and 15*c* using the management apparatus 30 disposed in the management region 1.

<Configurations of Respective Components>

(1) Schematic Configuration of Local Controller

Figure 3:
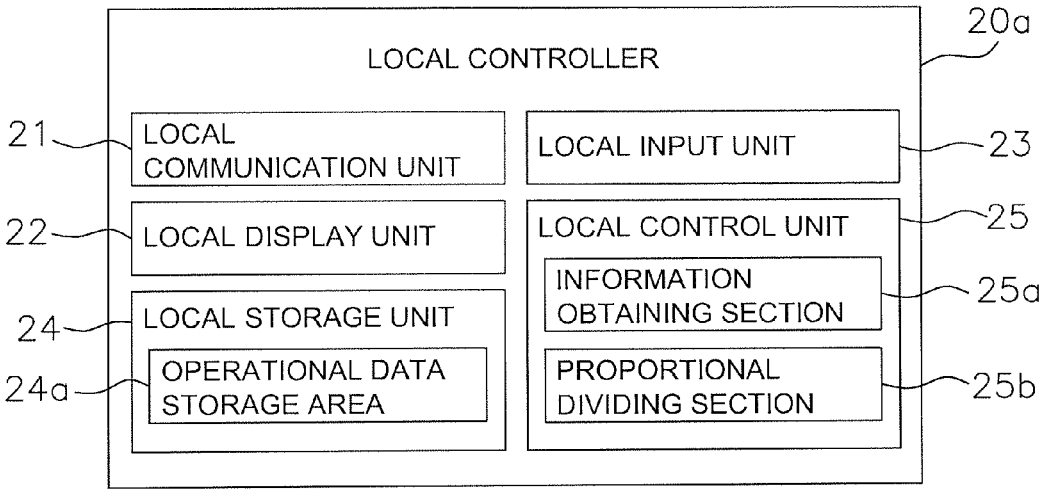
FIG. 3 is a schematic configuration diagram of a controller according to the exemplary embodiment.

As described above, the local controllers 20*a*, 20*b* and 20*c* are disposed in the buildings 50*a*, 50*b* and 50*c* on a one-to-one basis. Each of the local controllers 20*a*, 20*b* and 20*c* is used by a corresponding one of the administrators located in the respective buildings 50*a*, 50*b* and 50*c* for centrally controlling the plural sets of the air conditioners 13*a*, 13*b* and 13*c* installed in the respective buildings 50*a*, 50*b* and 50*c*. Specifically, each of the local controllers 20*a*, 20*b* and 20*c* is used for control of operational activation and deactivation, switching of operational modes, setting of a temperature, managing of operational conditions and the like with respect to the indoor units 12*aa*-12*ac*, 12*ba*-12*bc*, 12*ca*-12*cc* and the like installed in the corresponding one of the buildings 50*a*, 50*b* and 50*c*. The local controller 20*a* will be hereinafter explained with reference to FIG. 3. Configurations of the other local controllers 20*b* and 20*c* are the same as the configuration of the local controller 20*a*.

The local controller 20*a* mainly includes a local communication unit 21, a local display unit 22, a local input unit 23, a local storage unit 24 and a local control unit 25.

<Local Communication Unit>

The local communication unit 21 is a communication interface configured to communicate with the group management apparatus 30 and a corresponding one of the corresponding indoor units 12aa-12ac, 12ba-12bc, 12ca-12cc and the like. The local communication unit 21 is configured to send control signals to the respective indoor units 12aa-12ac, 12ba-12bc, 12ca-12cc and the like and receive operational data therefrom respectively. The term "operational data" herein refers to data related to operational histories and data related to operational conditions. Further, the term "data related to operational histories" refers to information regarding power on/off states, thermo-on/off states, operational modes (cooling mode, heating mode, ventilation mode, etc.), temperature settings, indoor temperatures (inhalation temperatures) and the like for the respective indoor units 12aa-12ad, 12ba-12bd, 12ca-12cd and the like. On the other hand, the term "data related to operational conditions" refers to values detected by a variety of sensors attached to the respective air conditioners 13a, 13b and 13c. Based on the operational data, it is possible to obtain operational time, opening degrees of indoor expansion valves, temperature divergence values, information as an index representing comfort and the like for the respective indoor units 12aa-12ad, 12ba-12bd, 12ca-12cd and the like. It should be noted that the term "operational time" in the present exemplary embodiment specifically refers to thermo-on time of the respective indoor units 12aa-12ad, 12ba-12bd, 12ca-12cd and the like. Further, the term "thermo-on time" herein refers to a period of time when each of the indoor units 12aa-12ad, 12ba-12bd, 12ca-12cd and the like conducts heating and cooling supply.

<Local Display Unit>

The local display unit 22 is a display screen configured to display the operational data of the respective indoor units 12aa-12ac, 12ba-12bc, 12ca-12cc and the like received by the local controller 20a. Further, the local display unit 22 functions as an operational screen configured to receive control commands for the respective indoor units 12aa-12ac, 12ba-12bc, 12ca-cc and the like.

<Local Input Unit>

The local input unit 23 mainly includes a touch panel covering the aforementioned display and operational keys.

<Local Storage Unit>

The local storage unit 24 mainly includes an operational data storage area 24a. The operational data storage area 24a stores the operational data of the respective indoor units 12aa-12ac, 12ba-12bc, 12ca-12cc and the like obtained by an information obtaining section 25a to be described. Further, the operational data storage area 24a stores information related to power consumption as the operational data. The term "information related to power consumption" specifically refers to a value of the total power consumption (i.e., total power consumption value) of the indoor units 12aa-12ac, 12ba-12bc, 12ca-12cc and the like measured by the wattmeter 70 and values of power consumption (i.e., power consumption values) of the respective indoor units 12aa-12ac, 12ba-12bc, 12ca-12cc and the like calculated by a proportional dividing section 25b to be described. It should be noted that the local storage unit 24 includes a storage area for a management program that is readable and executable by the local control unit 25 to be described in addition to the aforementioned area.

<Local Control Unit>

The local control unit 25 is configured to centrally manage a corresponding the indoor units 12aa-12ac, 12ba-12bc, 12ca-12cc and the like by running a management program stored in the local storage unit 24. The local control unit 25 mainly includes the information obtaining section 25a and the proportional dividing section 25b.

The information obtaining section 25a is configured to regularly access the air conditioners 13a, 13b and 13c for obtaining the operational data of the respective indoor units 12aa-12ac, 12ba-12bc, 12ca-12cc and the like. Further, the information obtaining section 25a is configured to obtain information of the total power consumption value measured by the wattmeter 70. The information obtained by the information obtaining section 25a is stored as the operational data in the aforementioned operational data storage area 24a.

The proportional dividing section 25b is configured to calculate power consumption values of the respective indoor units 12aa-12ac, 12ba-12bc, 12ca-12cc and the like based on the operational data stored in the operational data storage area 24a. Specifically, the power consumption values of the respective indoor units 12aa-12ac, 12ba-12bc, 12ca-12cc and the like are calculated by proportionally dividing the total power consumption value depending on information including such as the opening degrees of the expansion valves of the respective indoor units 12aa-12ac, 12ba-12bc, 12ca-12cc and the like, as described in Japan Laid-open Patent Application Publication No. JP-A-H05-157336. It should be noted that the power consumption values, calculated by the proportional dividing section 25b, are stored as the operational data in the aforementioned operational data storage area 24a.

Further, the local control unit 25 is configured to cause the local display unit 22 to display the operational conditions (e.g., operational activation/deactivation state, indoor temperature, operational mode, and whether or not troubles exist) of the indoor units 12aa-12ac, 12ba-12bc, 12ca-12cc and the like based on the obtained operational data. Yet further, the local control unit 25 is configured to conduct a variety of control operations (e.g., change of operational activation/deactivation states, change among operational modes such as the cooling mode, the heating mode and the ventilation mode, change of temperature) for the indoor units 12aa-12ac, 12ba-12bc, 12ca-12cc and the like based on the control commands received through the aforementioned local display unit 22.

(2) Schematic Configuration of Group Management Apparatus 30

A single group management apparatus 30 is installed in a standby location for a supervisory administrator in the management region 1. The term "supervisory administrator" herein refers to an administrator entirely managing the group management system 100. The group management apparatus 30 is connected to all the local controllers 20a, 20b and 20c in the management region 1. Further, the supervisory administrator arbitrarily classifies the indoor units 12aa-12ac, 12ba-12bc, 12ca-12cc and the like installed in the management region 1 into some groups. The group management apparatus 30 is configured to centrally manage the large number of indoor units 12aa-12ac, 12ba-12bc, 12ca-12cc and the like as the indoor unit groups 15a, 15b and 15c. In the present exemplary embodiment, as described above, the indoor units 12aa-12ac, 12ba-12bc, 12ca-12cc and the like installed in each of the buildings 50a, 50b and 50c is classified into one of the indoor unit groups.

Figure 4:
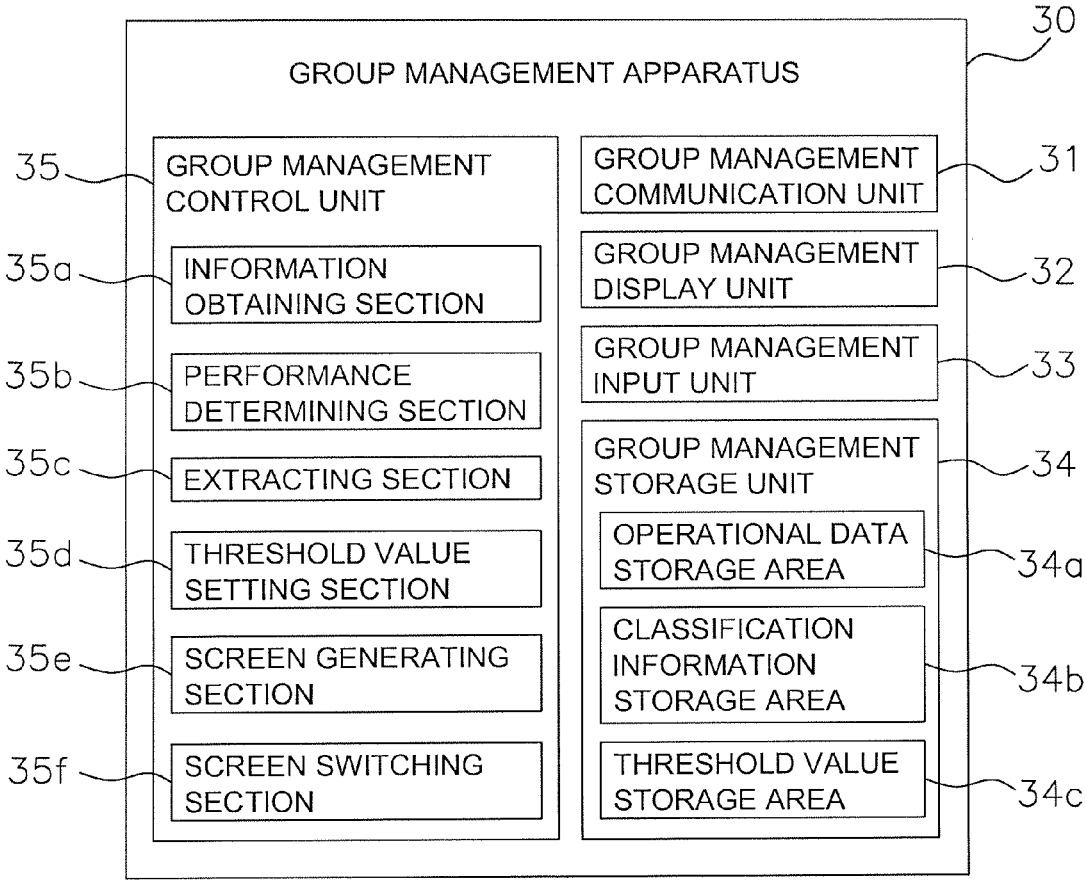
FIG. 4 is a schematic configuration diagram of a group management apparatus according to the exemplary embodiment.

As illustrated in FIG. 4, the group management apparatus 30 mainly includes a group management communication unit 31, a group management display unit 32, a group management input unit 33, a group management storage unit 34 and a group management control unit 35.

<Group Management Communication Unit>

The group management communication unit 31 is a communication interface configured to communicate with the local controllers 20a, 20b and 20c. The group management communication unit 31 is connected to the local communication unit 21 through the LAN.

<Group Management Display Unit>

The group management display unit 32 is a display configured to display a result obtained by running a group management program to be described. Further, the group management display unit 32 functions as an operational screen configured to receive control commands for the indoor unit groups 15*a*, 15*b* and 15*c* from a system administrator.

<Group Management Input Unit>

The group management input unit 33 mainly includes a touch panel covering the aforementioned display and operational keys.

<Group Management Storage Unit>

The group management storage unit 34 includes a storage area for a group management program that is readable and executable by the group management control unit 35 to be described. The group management storage unit 34 mainly includes an operational data storage area 34*a*, a classification information storage area 34*b* and a threshold value storage area 34*c*.

The operational data storage area 34*a* accumulates the operational data regarding the indoor units 12*aa*-12*ac*, 12*ba*-12*bc*, 12*ca*-12*cc* and the like obtained by an information obtaining section 35*a* to be described through the respective local controllers 20*a*, 20*b* and 20*c*. The operational data herein includes power consumption values calculated by proportional division operations of the proportional dividing sections 25*b* of the respective local controllers 20*a*, 20*b* and 20*c*, as well as the data related to operational histories and the data related to operational conditions. In other words, the plural data stored in the operational data storage areas 24*a* of the respective local storage units 24 as the plural operational data are obtained. Further, the operational data storage area 34*a* stores corrected values En of power consumption values calculated by a performance determining section 35*b* to be described.

The classification information storage area 34*b* stores information for classifying the indoor units 12*aa*-12*ac*, 12*ba*-12*bc*, 12*ca*-12*cc* and the like into the plural indoor unit groups 15*a*, 15*b* and 15*c* (i.e., classification information). The supervisory administrator is allowed to input the classification information through the aforementioned group management input unit 33. Therefore, a user is allowed to arbitrarily determine a variety of conditions including: physical conditions such as types and orientations of the buildings where the indoor units 12*aa*-12*ac*, 12*ba*-*bc*, 12*ca*-12*cc* and the like are installed; time conditions; and conditions for classifying the indoor units into groups such as common areas included in each building and types of the air conditioning facilities. In the present exemplary embodiment, as described above, the indoor units 12*aa*-12*ac*, 12*ba*-12*bc*, 12*ca*-12*cc* and the like, installed in each of the buildings 50*a*, 50*b* and 50*c*, is classified into one of the indoor unit groups 15*a*, 15*b* and 15*c*. More specifically, as illustrated in FIG. 1, all the indoor units 12*aa*-12*ac*, 12*ba*-12*bc*, 12*ca*-12*cc* and the like, installed in the management region, are classified, depending on the buildings 50*a*, 50*b* and 50*c* as the installation places thereof, into any one of the indoor unit group 15*a* in a BLDG. AA; the indoor unit group 15*b* in a BLDG. BB; and the indoor unit group 15*c* in a BLDG. CC.

The threshold value storage area 34*c* stores threshold values set by a threshold value setting section 35*d* to be described.

<Group Management Control Unit>

The group management control unit 35 is configured to run the aforementioned group management program and extract one or more groups satisfying predetermined conditions from all the indoor unit groups 15*a*, 15*b* and 15*c*. The group management control unit 35 mainly includes the information obtaining section 35*a*, the performance determining section 35*b*, an extracting section 35*c*, the threshold value setting section 35*d*, a screen generating section 35*e* and a screen switching section 35*f*.

The information obtaining section 35*a* is configured to obtain the operational data stored in the operational data storage areas 24*a* through the local controllers 20*a*, 20*b* and 20*c*.

The performance determining section 35*b* is configured to correct a power consumption value of each of the indoor units 12*aa*-12*ac*, 12*ba*-12*bc*, 12*ca*-12*cc* and the like stored in the operational data storage area 34*a* in consideration of air conditioning performance of each of the indoor units 12*aa*-12*ac*, 12*ba*-12*bc*, 12*ca*-12*cc* and the like. Specifically, the performance determining section 35*b* is configured to calculate a value (corrected value) En by dividing a power consumption value of each of the indoor units 12*aa*-12*ac*, 12*ba*-12*bc*, 12*ca*-12*cc* and the like by an air conditioning performance of each of the indoor units 12*aa*-12*ac*, 12*ba*-12*bc*, 12*ca*-12*cc* and the like. The term "air conditioning performance" herein refers to horsepower, capacity (kW) or the like of each of the indoor units 12*aa*-12*ac*, 12*ba*-12*bc*, 12*ca*-12*cc* and the like. The corrected values En, calculated by the performance determining section 35*b*, are stored in the aforementioned operational data storage area 34*a*.

The extracting section 35*c* is configured to extract one or more groups satisfying predetermined conditions from all the indoor unit groups 15*a*, 15*b* and 15*c* based on a plurality of assessment perspectives. The assessment perspectives herein include heavy power consumption, long time operation and reduction in comfort. One or more indoor unit groups satisfying predetermined conditions refers to a group with occurrence of a trouble such as heavy power consumption, long time operation or reduction in comfort, and the group having a value greater than a threshold value. Further, the extracting section 35*c* is configured to extract one or more groups having a value greater than a threshold value regarding each of: sum of operational data values (i.e., entire value) of all the indoor units belonging to each of the indoor unit groups 15*a*, 15*b* and 15*c*; and an operational data value per unit (i.e., individual value) of the indoor units belonging to each of the indoor unit groups 15*a*, 15*b* and 15*c*. Specifically, the extracting section 35*c* is configured to compare a threshold value and entire values of all the indoor units belonging to the respective indoor unit groups 15*a*, 15*b* and 15*c* and extract one or more groups having an entire value greater than the threshold value from all the indoor unit groups 15*a*, 15*b* and 15*c*. Further, the extracting section 35*c* is configured to compare a threshold value and individual values of the indoor units belonging to the respective indoor unit groups 15*a*, 15*b* and 15*c* and extract one or more groups having an individual value greater than the threshold value from all the indoor unit groups 15*a*, 15*b* and 15*c*. The threshold value setting section 35*d* to be described is configured to set a threshold value for each of the entire value and the individual value with respect to each of the assessment perspectives.

The threshold value setting section 35*d* is configured to set the threshold values based on the information stored in the operational data storage area 34*a*. Details thereof will be explained in the following section "Assessment Perspectives and Processing Method". It should be noted that the aforementioned threshold value storage area 34*c* stores the threshold values set by the threshold value setting section 35*d*.

The screen generating section 35*e* is configured to generate screens to be displayed on the group management display unit 32 for representing results extracted by the extracting section 35*c*. It should be noted that the screen generating section 35*e* is configured to generate a first screen and a second screen. The first screen represents a result extracted by the extracting section 35*c* regarding the entire values (see FIGS. 5A, 6A and 7A). The second screen represents a result extracted by the extracting section 35*c* regarding the individual values (see FIGS. 5B, 6B and 7B). Each of the first and second screens is a screen allowed to switchably display the results of the aforementioned plural assessment perspectives.

The screen switching section 35*f* is configured to switch a given screen currently displayed on the group management display unit 32 to another screen in response to a command received from a user through the group management input unit 33. For example, the screen switching section 35*f* is configured to switch back and forth the first and second screens generated by the screen generating section 35*e*.

<Assessment Perspectives and Processing Method>

The following relates to explanation of predetermined troubles of one or more indoor unit groups extracted by the group management apparatus 30 of the present exemplary embodiment, i.e., heavy power consumption, long time operation, and reduction in comfort.

(A) Heavy Power Consumption

The term "heavy power consumption" refers to a large power consumption value. In the group management apparatus 30, the extracting section 35*c* is configured to extract one or more groups having a power consumption value greater than a threshold value from all the indoor units groups 15*a*, 15*b* and 15*c*. Further, one or more groups extracted from the indoor unit groups 15*a*, 15*b* and 15*c* are displayed in a descending order of power consumption values on the screens of extracted results (i.e., the first and second screens) displayed on the group management display unit 32. It should be noted that the herein used power consumption values are corrected values En obtained by the correction of the performance determining section 35*b*.

Figure 5A:
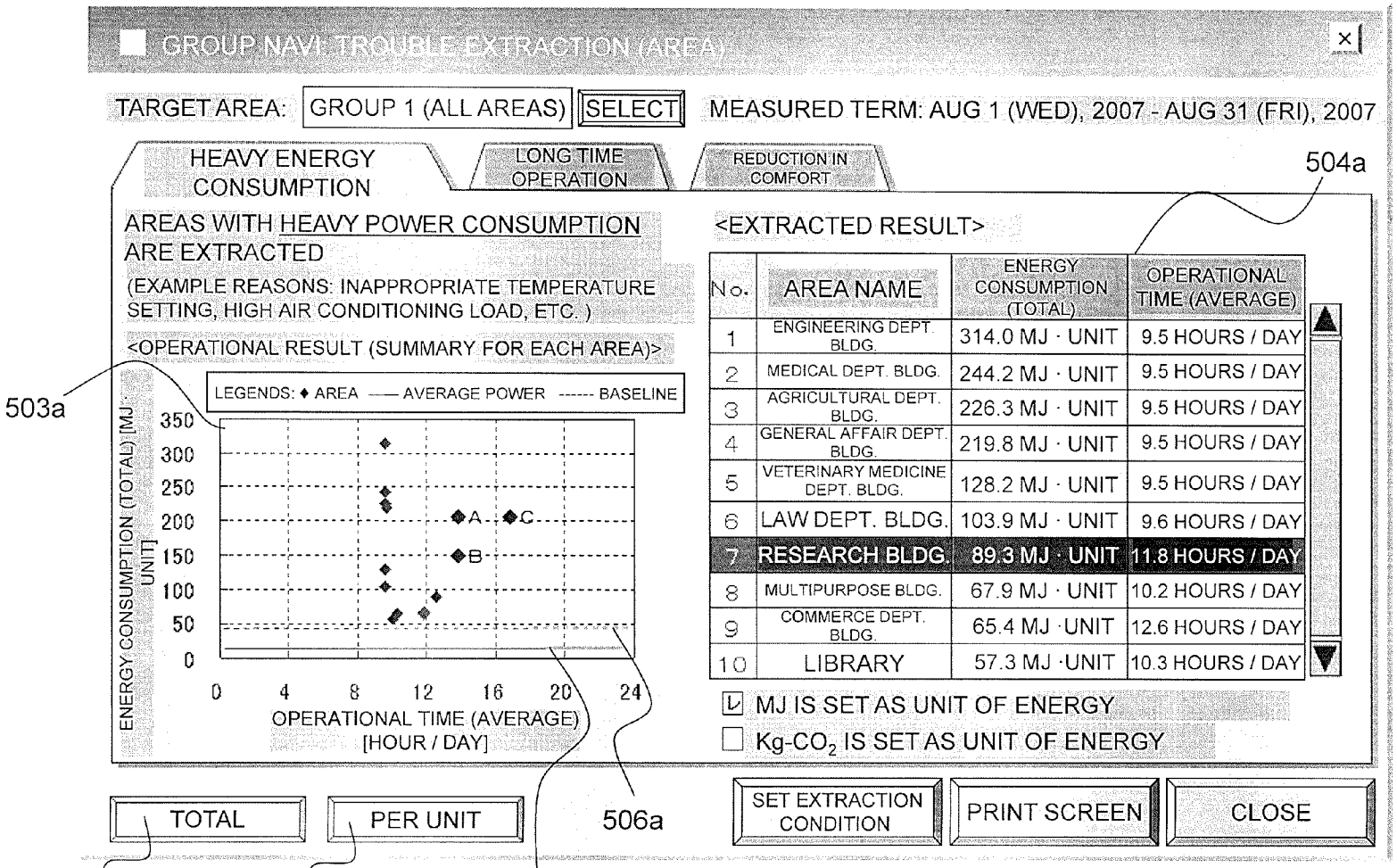
FIG. 5A is a screen displaying a result of extracting entire values based on heavy power consumption.
Figure 5B:
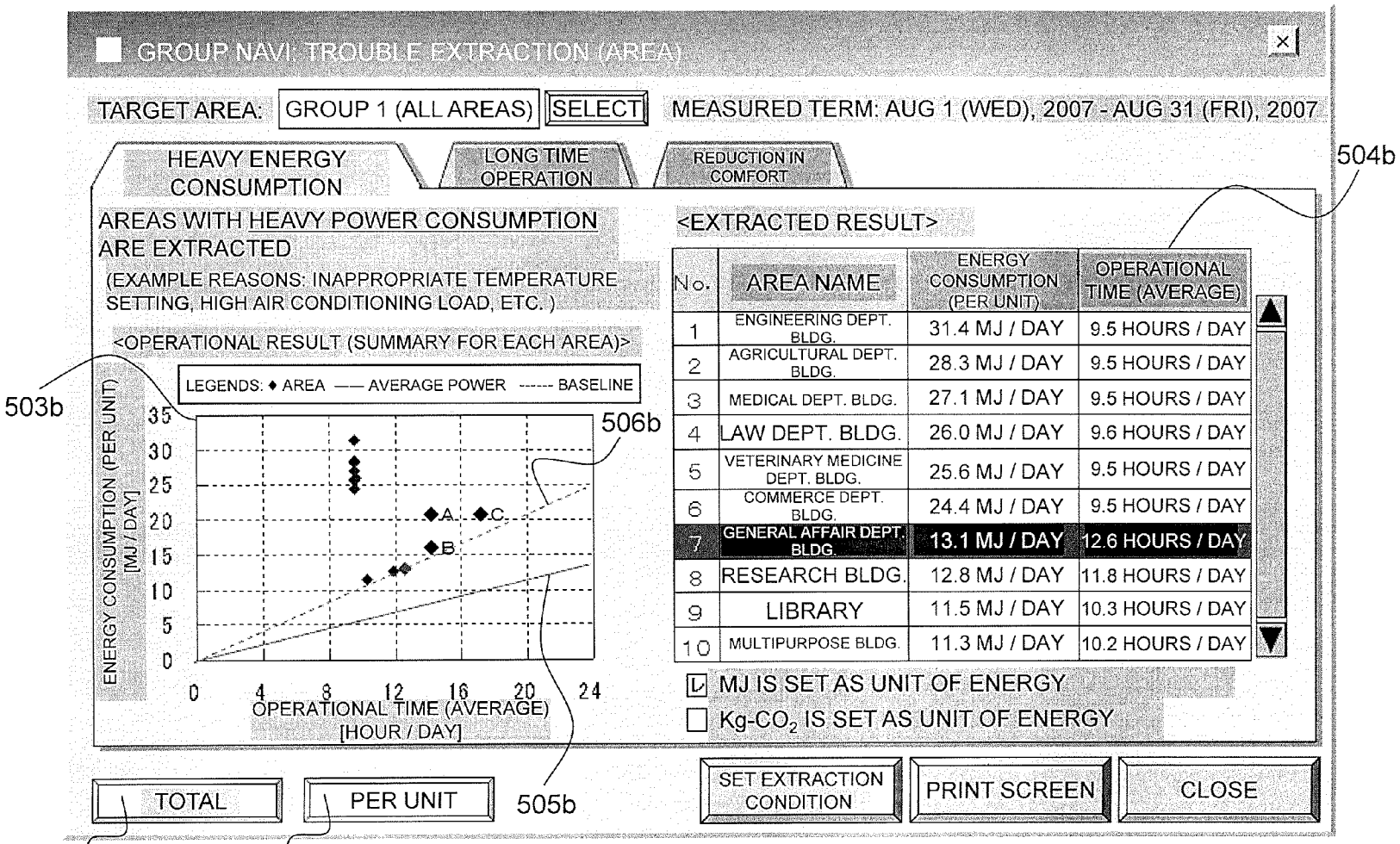
FIG. 5B is a screen displaying a result of extracting individual values based on heavy power consumption.

FIGS. 5A and 5B illustrate screens representing extracted results regarding heavy power consumption.

In FIG. 5A, a given indoor unit group is extracted from the indoor unit groups 15*a*, 15*b* and 15*c* when sum of power consumption values (i.e., entire value) of the indoor units 12*aa*-12*ad*, 12*ba*-12*bd*, 12*ca*-12*cd* and the like belonging thereto is greater than a threshold value. The threshold value herein refers to a value determined using average of the entire values of all the indoor unit groups 15*a*, 15*b* and 15*c* (i.e., baseline value). Specifically, the average herein refers to average of sum of power consumption values of the indoor units belonging to the indoor unit group 15*a*, sum of power consumption values of the indoor units belonging to the indoor unit group 15*b*, and sum of power consumption values of the indoor units belonging to the indoor unit group 15*c*. Simply put, average is obtained by the following equation (I).

⟨Math. 1⟩

$$\bar{y} = \frac{\sum y_i}{i} \tag{I}$$

$$\begin{cases} y_i\text{: total power consumption of an indoor unit group } i \\ \quad \left(\begin{array}{l}\text{(sum of power consumptions of all the indoor} \\ \text{units belonging to the indoor unit group } i\end{array}\right) \\ i\text{: the number of indoor unit groups as analysis targets} \end{cases}$$

Further, the baseline value is obtained by the following equation (II).

⟨Math. 2⟩

$$y = k \cdot \bar{y} \tag{II}$$

$$\begin{cases} y\text{: a baseline value of heavy power consumption} \\ k\text{: a given value} \\ \bar{y}\text{: average} \end{cases}$$

The extracting section 35*c* is configured to compare the baseline value (i.e., threshold value) and entire values per day in a predetermined term (i.e., measured term in the figures) specified by the supervisory administrator and extract one or more groups having a value greater than the threshold value from all the indoor unit groups.

In FIG. 5B, a given indoor unit group is extracted from the indoor unit groups 15*a*, 15*b* and 15*c* when an individual value of power consumption values of the indoor units 12*aa*-12*ad*, 12*ba*-12*bd*, 12*ca*-12*cd* and the like belonging thereto is greater than a threshold value. The threshold value herein refers to a value determined using average of the individual values of the indoor unit groups 15*a*, 15*b* and 15*c*. The average of the individual values of the indoor unit groups 15*a*, 15*b* and 15*c* herein refers to average of per-unit averages of power consumption values of the indoor units 12*aa*-12*ad*, 12*ba*-12*bd*, 12*ca*-12*cd* and the like belonging to the respective indoor unit groups 15*a*, 15*b* and 15*c*. Further, a baseline value is determined by the equation "y=k·a·x" where "y" is a baseline value for power consumption values in a predetermined term; "x" is average of operational time in a predetermined term; "k" is a predetermined value determined in setting an extraction condition; and "a" is a slope of average power. The average power can be expressed as an approximated line calculated using the least square method with respect to both average of power consumption values of the indoor units in a predetermined term and average of operational time of the indoor units in a predetermined term. It should be noted that an approximated curve can be expressed by the formula "y=a·x" where average of power consumption values in a predetermined term is set as "y(i) [i=1, 2, . . . n (n: the number of indoor units)]"; and average of operational time in a predetermined term is set as "x(i) [i=1, 2, . . . n (n: the number of indoor units)]", and slope "a" is obtained by the following equation (III) that minimizes square error.

⟨Math. 3⟩

$$a = \frac{\sum_{i=1}^{n} x_i \cdot y_i}{\sum_{i=1}^{n} x_i^2} \tag{III}$$

The extracting section 35c is configured to compare the baseline value (i.e., threshold value) and entire values per day in a predetermined term (i.e., measured term in the figures) specified by the supervisory administrator and extract one or more groups having a value greater than the threshold value from all the indoor unit groups.

It should be noted that buttons 501 and 502 illustrated in FIGS. 5A and 5B are used for activating the screen switching section 35*f*. When the button 501 is pressed, the screen switching section 35*f* is configured to switch the screen of FIG. 5B representing an extracted result of the individual values to the screen of FIG. 5A representing an extracted result of the entire values. When the button 502 is pressed, on the other hand, the screen switching section 35*f* is configured to switch the screen of FIG. 5A representing the extracted result of the entire values to the screen of FIG. 5B representing the extracted result of the individual values.

<Extraction Method>

Figure 5C:
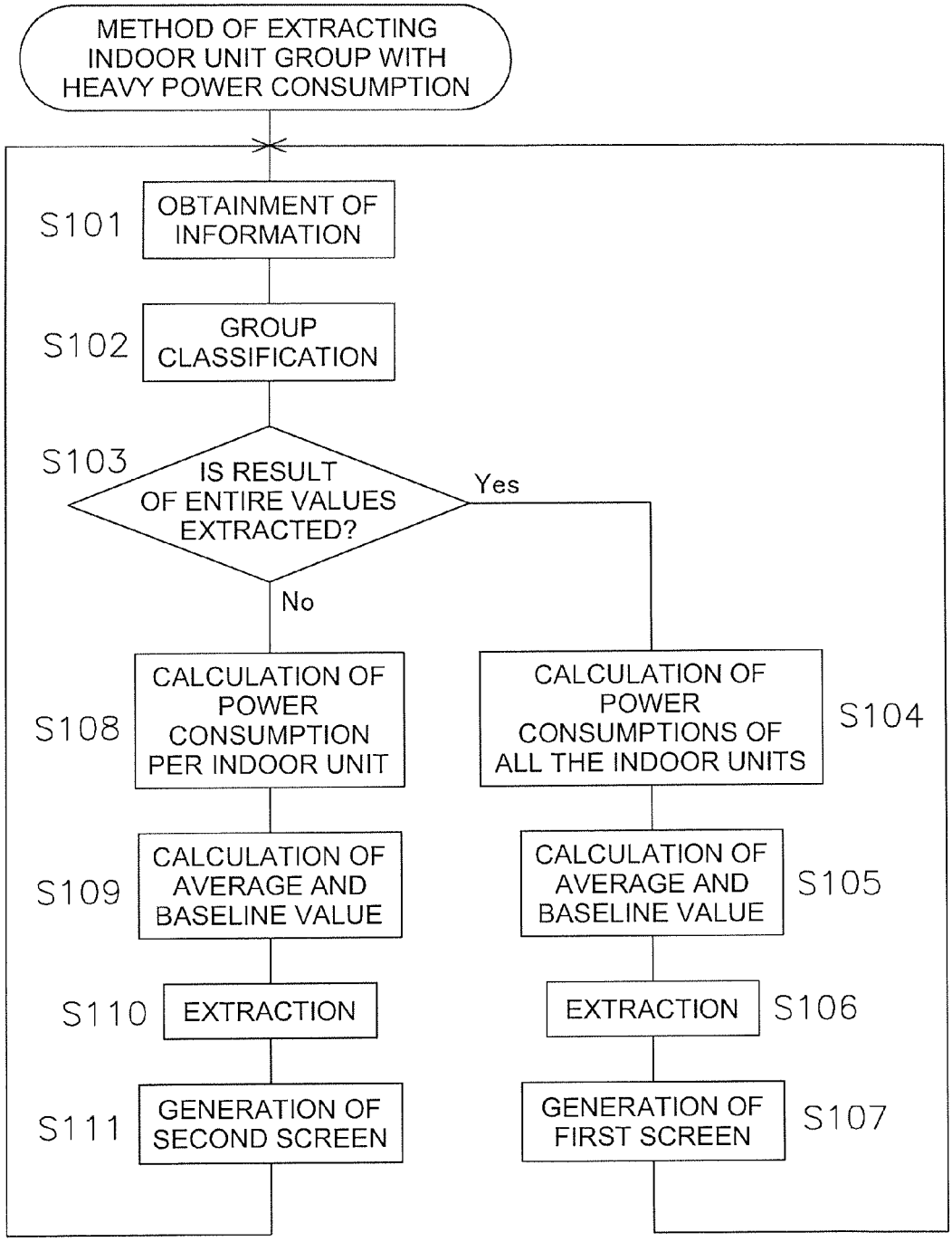
FIG. 5C is a flowchart representing a series of steps for extracting a result based on heavy power consumption.

Next, a method of extracting one or more indoor unit groups based on the perspective of heavy power consumption will be explained with reference to FIG. 5C. In Step S101, the information obtaining section 35*a* obtains the operational data. In subsequent Step S102, the indoor units 12*aa*-12*ad*, 12*ba*-12*bd*, 12*ca*-12*cd* and the like are classified into the indoor unit groups 15*a*, 15*b* and 15*c* based on the information stored in the classification information storage area 34*b*. Next, it is determined in Step S103 whether or not an extracted result of entire values should be displayed. The processing proceeds to Step S104 if the extracted result of the entire values is determined to be displayed in Step S103. In Step S104, sum of power consumption values (i.e., entire value) is calculated for the indoor units 12*aa*-12*ad*, 12*ba*-12*bd*, 12*ca*-12*cd* and the like belonging to each of the indoor unit groups 15*a*, 15*b* and 15*c*. Further, average of the entire value per day in a predetermined term is calculated. In subsequent Step S105, average of the entire values of all the indoor unit groups is calculated as a part of a threshold value to be used for an extraction processing of the extracting section 35*c*. Further, the threshold value (i.e., baseline value) is calculated based on the above calculated average. In subsequent Step S106, one or more groups having an entire value greater than the baseline value is extracted from all the indoor unit groups. In Step S107, the extracted result is displayed on the first screen generated by the screen generating section 35*e*. An average 505*a* and a baseline value 506*b*, together with the extracted result, are displayed on the first screen. On the other hand, the processing proceeds to Step S108 if the extracted result of the entire values is determined not to be displayed in the aforementioned Step S103, in other words, if an extracted result of the individual values is displayed. In Step S108, a power consumption value per unit (i.e., individual value) is calculated for the indoor units 12*aa*-12*ad*, 12*ba*-12*bd*, 12*ca*-12*cd* and the like belonging to each of the indoor unit groups 15*a*, 15*b* and 15*c*. Further, average of the individual value per day in a predetermined term is calculated. In subsequent Step S109, average of the individual values of all the indoor unit groups is calculated as a part of a threshold value to be used for an extraction operation by the extracting section 35*c*. Further, the threshold value (i.e., baseline value) is calculated based on the above calculated average. In subsequent Step S110, one or more indoor unit groups to which indoor units having an individual value greater than the baseline value belong is extracted from all the indoor unit groups. In Step S111, the extracted result is subsequently displayed on the second screen generated by the screen generating section 35*e*.

<Extraction Screen>

In a chart 503*a* on the first screen, an entire value per day (i.e., average) is plotted with respect to each of the indoor unit groups extracted by the extracting section 35*c*. In the chart 503*a*, the vertical axis represents sum of power consumption values (i.e., entire value) of the indoor units belonging to each of the extracted indoor unit groups, whereas the horizontal axis represents operational time per day (i.e., average) in a measured term of the entire value. In a chart 503*b* on the second screen, an individual value per day (i.e., average) is plotted with respect to one or more indoor unit groups extracted by the extracting section 35*c*. In the chart 503*b*, the vertical axis represents a power consumption value per unit (i.e., individual value) of the indoor units belonging to each of the extracted indoor unit groups, whereas the horizontal axis represents operational time per day (i.e., average) in the measured term of the individual value. Lines are displayed in the chart 503*a* for representing an average 505*a* and a baseline value 506*a*, whereas lines are displayed in the chart 503*b* for representing an average 505*b* and a baseline value 506*b*. The extracted results are listed in a descending order of power consumption values in a table 504*a* on the first screen and a table 504*b* on the second screen. When a given group is selected from the extracted indoor unit groups (buildings in the present exemplary embodiment) listed in the tables 504*a* and 504*b*, a corresponding legend is configured to perform a predetermined action (e.g., blinking) in the charts 503*a* and 503*b*.

(B) Long Time Operation

An operation of a given indoor unit is determined as a long time operation when a total operational time per day of the indoor unit is greater than a predetermined value. The predetermined value is herein set by a user. In the present exemplary embodiment, a given day is counted as an occurrence day with a long time operation when an operational time is greater than 20 hours (i.e., predetermined value) in the day. The extracting section 35*c* is configured to extract one or more groups having the number of occurrence days with operational hours greater than a threshold value from all the indoor unit groups. The threshold value herein refers to both average of entire values and average of individual values. Further, average of entire values is average of sums of the number of occurrence days with a long time operation among all the indoor unit groups 15*a*, 15*b* and 15*c*. Specifically, average of entire values is average of: sum of the number of occurrence days with a long time operation of all the indoor units belonging to the indoor unit group 15*a*; sum of the number of occurrence days with a long time operation of all the indoor units belonging to the indoor unit group 15*b*; and sum of the number of occurrence days with a long time operation of all the indoor units belonging to the indoor unit group 15*c*. On the other hand, average of individual values herein refers to average of the number of occurrence days with a long time operation per unit of the indoor units belonging to the respective indoor unit groups 15*a*, 15*b* and 15*c*. One or more groups extracted from the indoor unit groups 15*a*, 15*b* and 15*c* are displayed in a descending order of the number of days determined as the number of occurrence days with a long time operation on the screen of the extracted result displayed on the group management display unit 32.

Figure 6A:
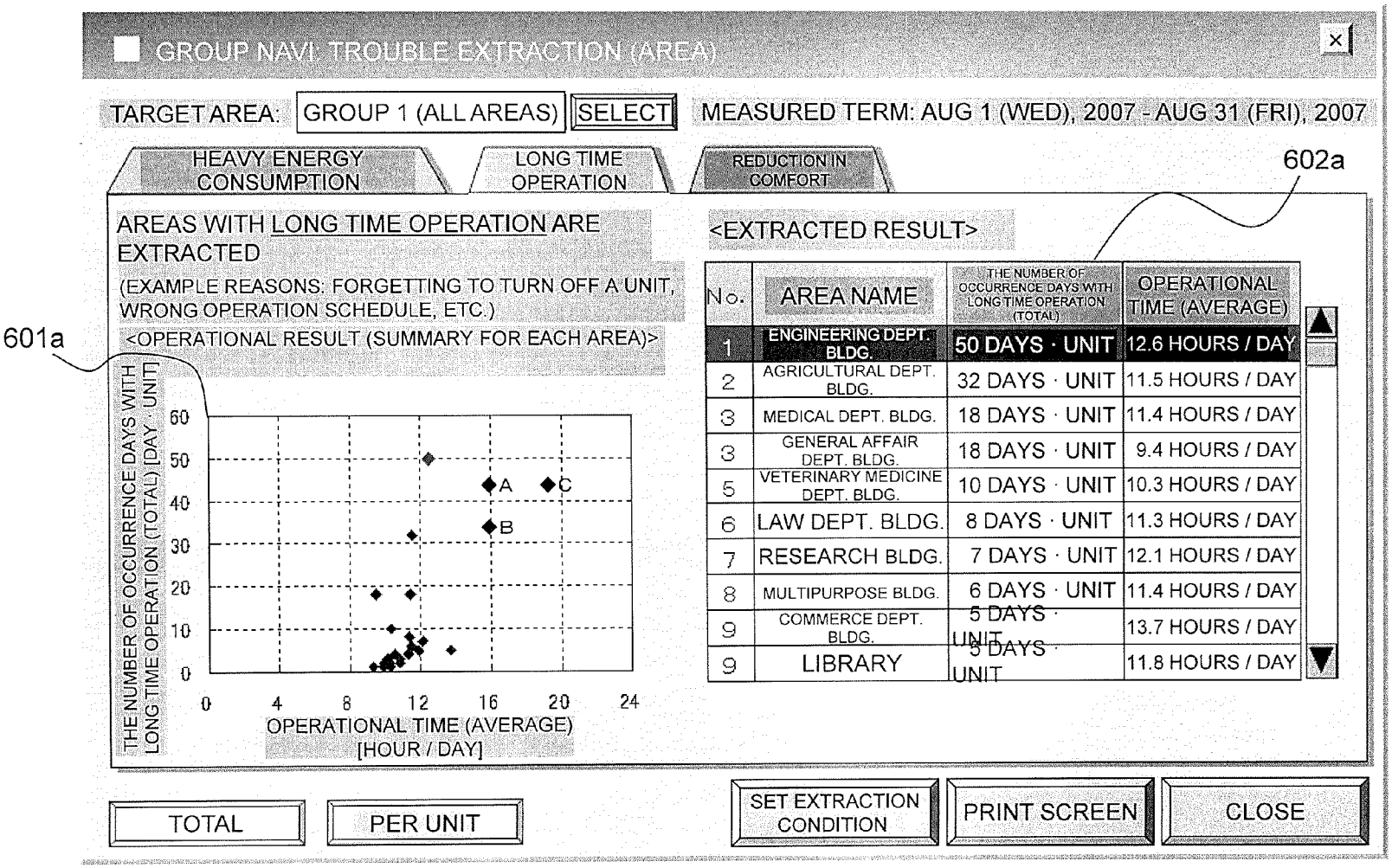
FIG. 6A is a screen displaying a result of extracting entire values based on a long time operation.
Figure 6B:
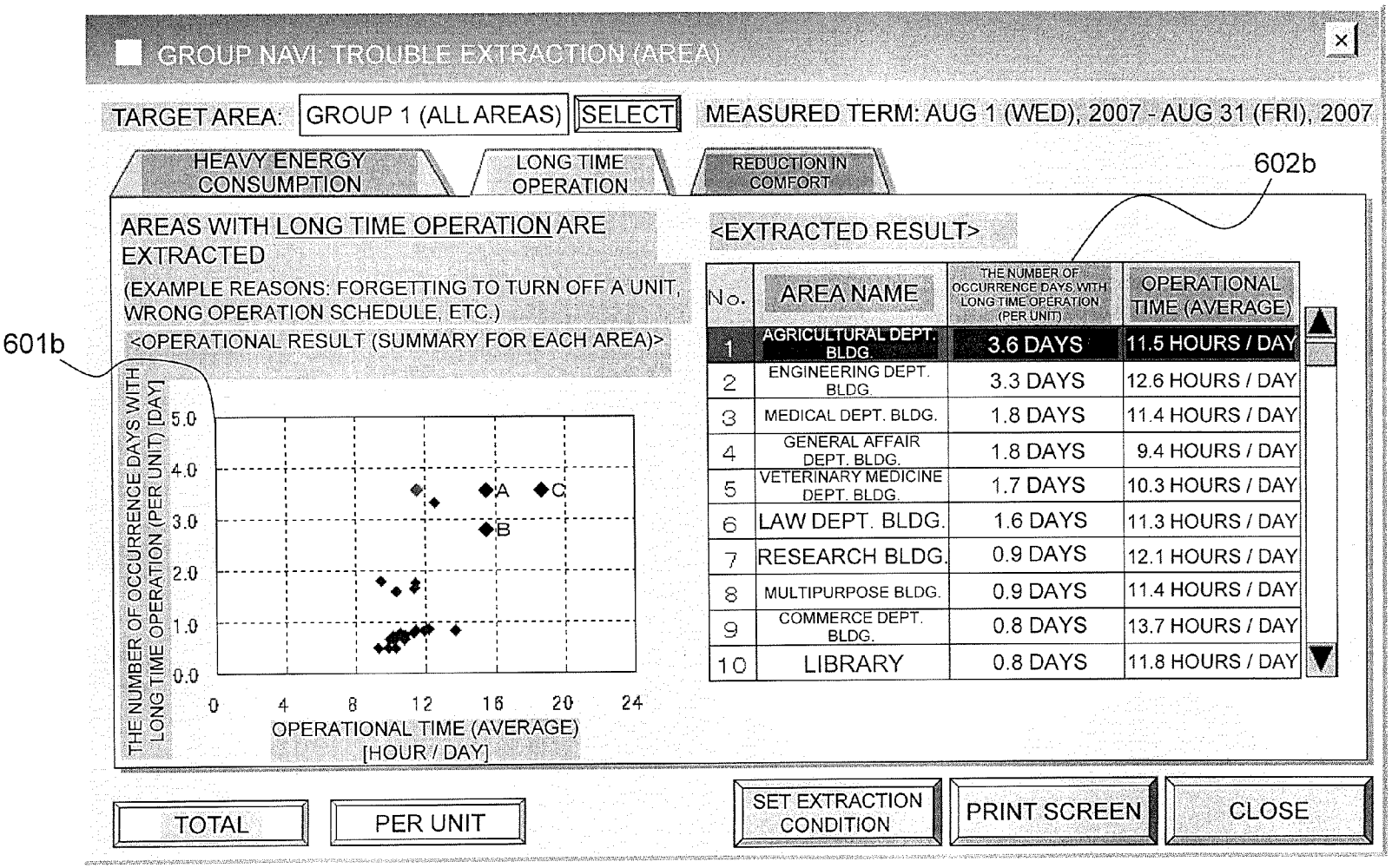
FIG. 6B is a screen displaying a result of extracting individual values based on a long time operation.

FIGS. 6A and 6B illustrate screens displaying extraction results regarding a long time operation. In FIG. 6A, a given indoor unit group is extracted from all the indoor unit groups 15*a*, 15*b* and 15*c* when sum of the number of occurrence days with a long time operation (i.e., entire value) of the indoor units 12*aa*-12*ad*, 12*ba*-12*bd*, 12*ca*-12*cd* and the like belonging to the indoor unit group is greater than a threshold value (i.e., average) in a predetermined term. In FIG. 6B, a given indoor unit group is extracted from all the indoor unit groups 15*a*, 15*b* and 15*c* when the number of occurrence days with a long time operation per unit (i.e., individual value) of the indoor units 12*aa*-12*ad*, 12*ba*-12*bd*, 12*ca*-12*cd* and the like belonging to the indoor unit group is greater than a threshold value (i.e., average) in a predetermined term. The group management apparatus 30 is configured to display the extracted indoor units in a descending order of the number of occurrence days with a long time operation.

<Extraction Method>

Figure 6C:
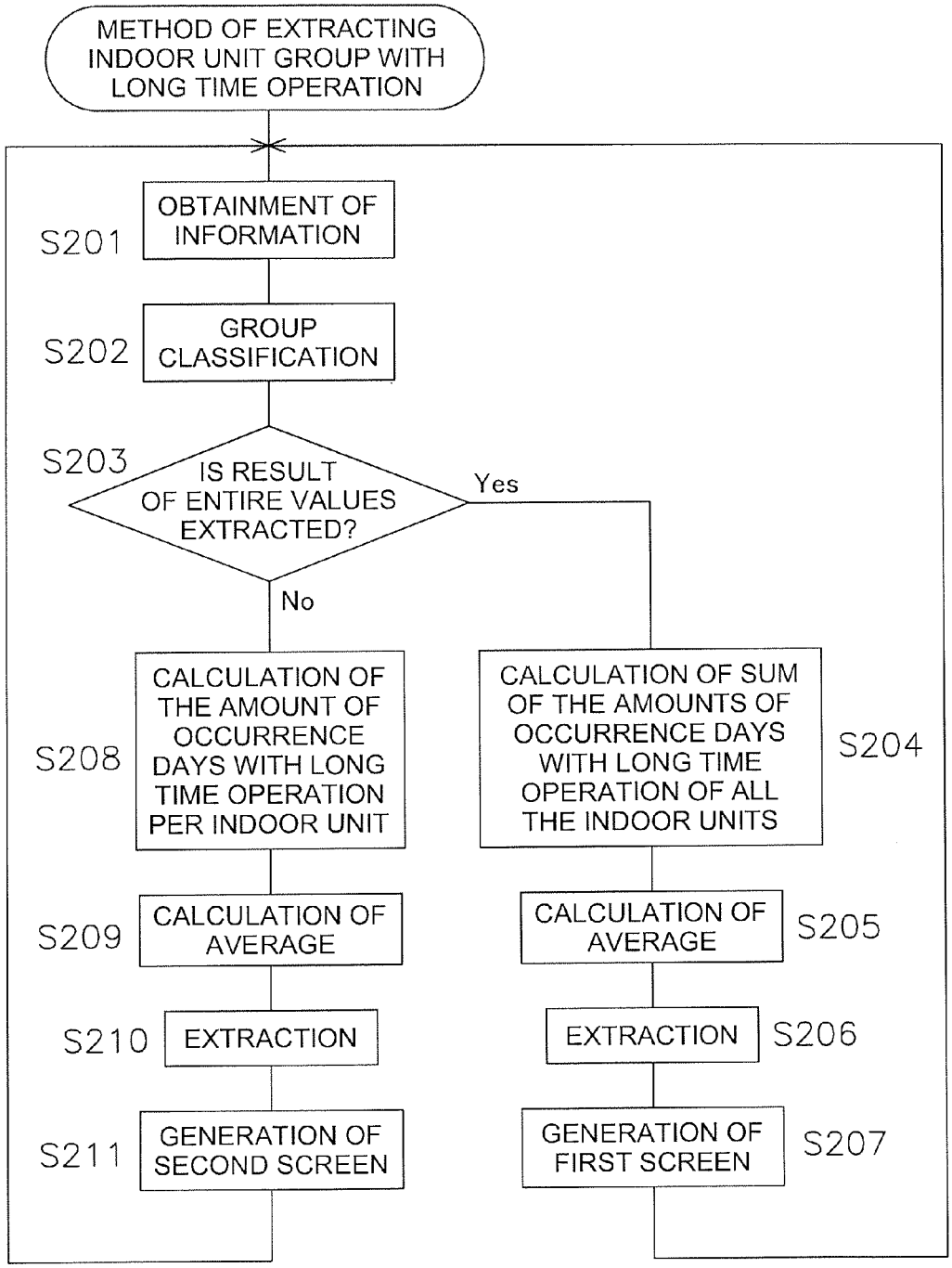
FIG. 6C is a flowchart representing a series of steps for extracting a result based on a long time operation.

Next, a method of extracting an indoor unit group based on the perspective of a long time operation will be explained with reference to FIG. 6C. In Step S201, the information obtaining section 35*a* obtains operational data. In subsequent Step S202, the indoor units 12*aa*-12*ad*, 12*ba*-12*bd*, 12*ca*-12*cd* and the like are classified into the indoor unit groups 15*a*, 15*b* and 15*c* based on the information stored in the classification information storage area 34*b*. Next, it is determined in Step S203 whether or not an extracted result of entire values should be displayed. The processing proceeds to Step S204 if the extracted result of the entire values is determined to be displayed in Step S203. In Step S204, sum of the number of occurrence days with a long time operation (i.e., entire value) is calculated for the indoor units 12*aa*-12*ad*, 12*ba*-12*bd*, 12*ca*-12*cd* and the like belonging to each of the indoor unit groups 15*a*, 15*b* and 15*c*. In subsequent Step S205, average of the entire values is calculated. In Step S206, one or more groups having an entire value greater than the calculated average is extracted from all the indoor unit groups. In Step S207, the extracted result is displayed on the first screen generated by the screen generating section 35*e*. On the other hand, the processing proceeds to Step S208 if the extracted result of the entire values is determined not to be displayed in the aforementioned Step S203, in other words, if an extracted result of the individual values is displayed. In Step S208, the number of occurrence days with a long time operation per unit (i.e., individual value) is calculated for the indoor units 12*aa*-12*ad*, 12*ba*-12*bd*, 12*ca*-12*cd* and the like belonging to each of the indoor unit groups 15*a*, 15*b* and 15*c*. In subsequent Step S209, average of the individual values is calculated. In Step S210, one or more indoor unit groups to which indoor units having an individual value greater than the calculated average belong is extracted from all the indoor unit groups. In Step S211, the extracted result is subsequently displayed on the second screen generated by the screen generating section 35*e*.

<Extraction Screen>

In a chart 601*a* on the first screen, an entire value of a long time operation is plotted with respect to each of the indoor unit groups extracted by the extracting section 35*c*. In the chart 601*a*, the vertical axis represents sum of the number of occurrence days with a long time operation (i.e., entire value) of the indoor units belonging to each of the extracted indoor unit groups, whereas the horizontal axis represents operational time per day (i.e., average) in a measured term of the entire value. A case will be herein assumed that two of a large number of indoor units belonging to a given indoor unit group are respectively operated for 22 hours in a day. In this case, the data is plotted in a coordinate of the chart 601*a* where a value in the vertical axis corresponds to two (days) and a value in the horizontal axis corresponds to 22 (hours). In a chart 601*b* on the second screen, an individual value is plotted with respect to one re more indoor unit groups extracted by the extracting section 35*c*. In the chart 601*b*, the vertical axis represents the number of occurrence days with a long time operation per unit (i.e., individual value) of the indoor units belonging to each of the extracted indoor unit groups, whereas the horizontal axis represents an operational time per day (i.e., average) in a measured term of the individual value. In the aforementioned case that two of a large number of indoor units belonging to a given indoor unit group are respectively operated for 22 hours in a day, the data is plotted in a coordinate of the chart 601*b* where a value in the vertical axis corresponds to one (day) and a value in the horizontal axis corresponds to 22 (hours). The extracted results are listed in a descending order of magnitude of long time operations in a table 602*a* on the first screen and a table 602*b* on the second screen. When a given group is selected from the extracted indoor unit groups (buildings in the present exemplary embodiment) listed in the tables 602*a* and 602*b*, a corresponding legend is configured to perform a predetermine action (e.g., blinking) in the charts 602*a* and 602*b* 601*a* and 601*b*, similarly to the screens displaying the extraction results of heavy power consumption (see FIGS. 5A and 5B).

(C) Reduction in Comfort

The term "reduction in comfort" herein refers to a condition that deviation is produced between a temperature setting configured in a given indoor unit and an inhalation temperature of the indoor unit, more specifically, refers to a condition that a deviation value between the temperature setting and the inhalation temperature is greater than or equal to a predetermined value. The predetermined value is herein set by a user. In the present exemplary embodiment, a given condition is determined as a condition with reduction in comfort when a deviation between a temperature setting and an inhalation temperature is greater than 2 degrees Celsius (i.e., predetermined value). The extracting section 35*c* is configured to extract a given indoor unit group from all the indoor unit groups 15*a*, 15*b* and 15*c* when the amount of time that reduction in comfort occurs in the group (i.e., the amount of comfort reduction time) is greater than a threshold value. The threshold value herein refers to both average of entire values and average of individual values. Further, average of entire values herein refers to average of sums of the amount of comfort reduction time of the respective indoor unit groups 15*a*, 15*b* and 15*c*. Specifically, average of entire values is average of: sum of the amount of comfort reduction time of all the indoor units belonging to the indoor unit group 15*a*; sum of the amount of comfort reduction time of all the indoor units belonging to the indoor unit group 15*b*; and sum of the amount of comfort reduction time of all the indoor units belonging to the indoor unit group 15*c*. On the other hand, average of individual values herein refers to average of per-unit averages of the amount of comfort reduction time of the indoor units belonging to the respective indoor unit groups 15*a*, 15*b* and 15*c*. The indoor unit groups 15*a*, 15*b* and 15*c* are configured to be displayed in a descending order of the amounts of comfort reduction time on the screen of the extracted results displayed on the group management display unit 32.

Figure 7A:
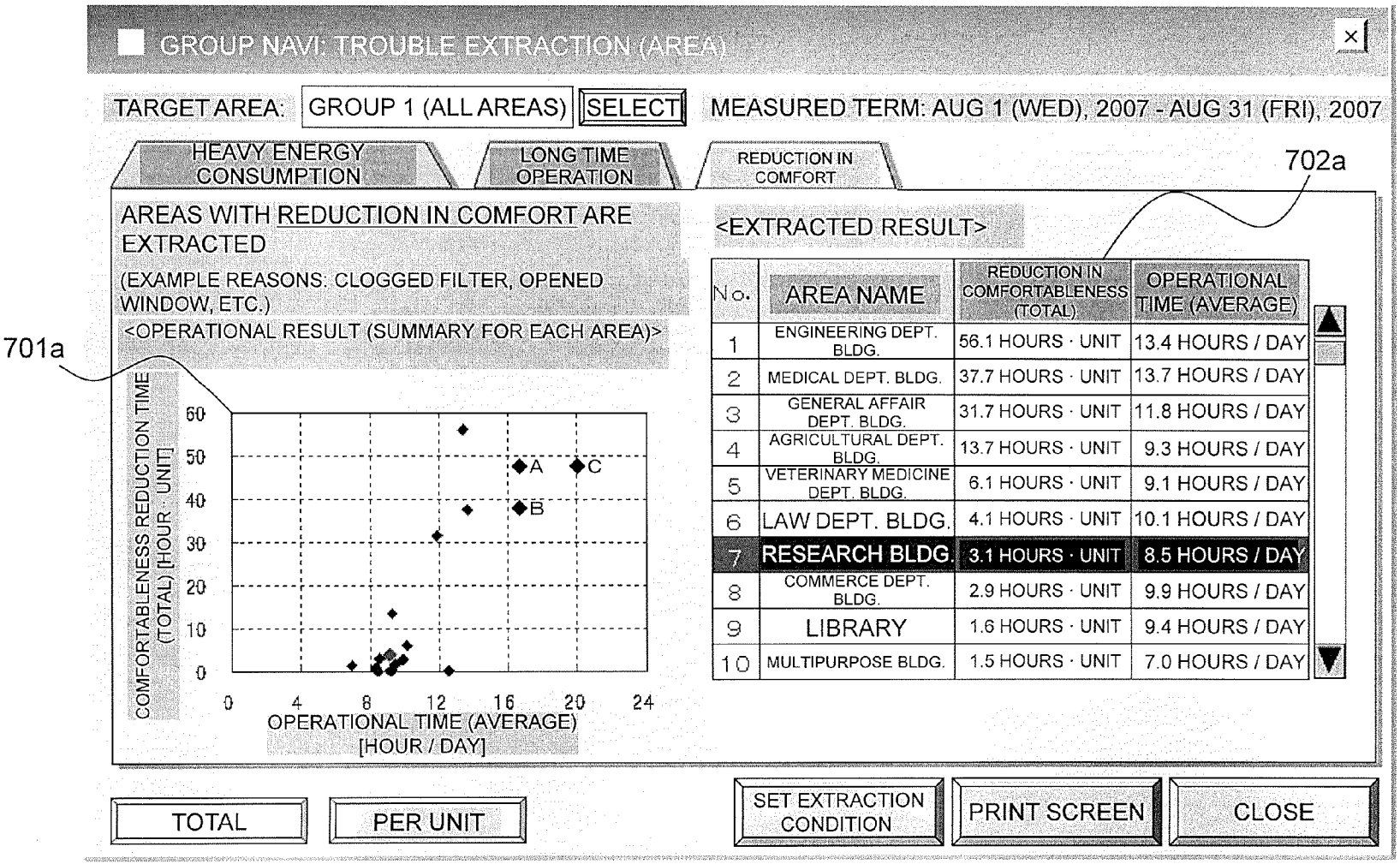
FIG. 7A is a screen displaying a result of extracting entire values based on reduction in comfort.
Figure 7B:
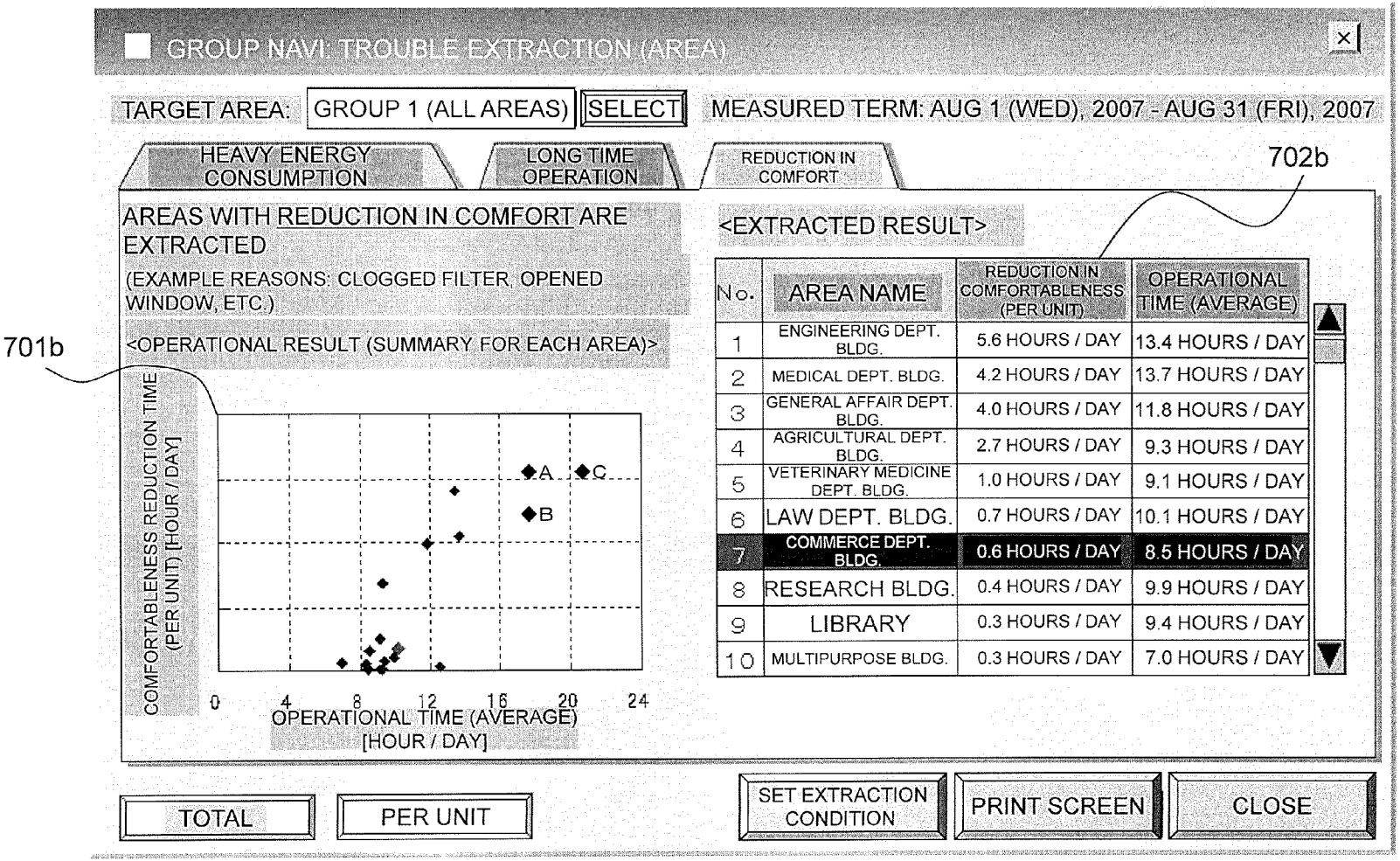
FIG. 7B is a screen displaying a result of extracting individual values based on reduction in comfort.

FIGS. 7A and 7B are screens displaying extracted results regarding reduction in comfort. In FIG. 7A, a given indoor unit group is extracted from all the indoor unit groups 15*a*, 15*b* and 15*c* when sum of the amount of comfort reduction time (i.e., entire value) of the indoor units 12*aa*-12*ad*, 12*ba*-12*bd*, 12*ca*-12*cd* and the like belonging to the indoor unit group is greater than a threshold value (i.e., average) in a predetermined term. In FIG. 7B, on the other hand, a given indoor unit group is extracted from all the indoor unit groups 15*a*, 15*b* and 15*c* when the amount of comfort reduction time per unit (i.e., individual value) of the indoor units 12*aa*-12*ad*, 12*ba*-12*bd*, 12*ca*-12*cd* and the like belonging to the indoor unit group is greater than a threshold value (i.e., average) in a predetermined term.

<Extraction Method>

Figure 7C:
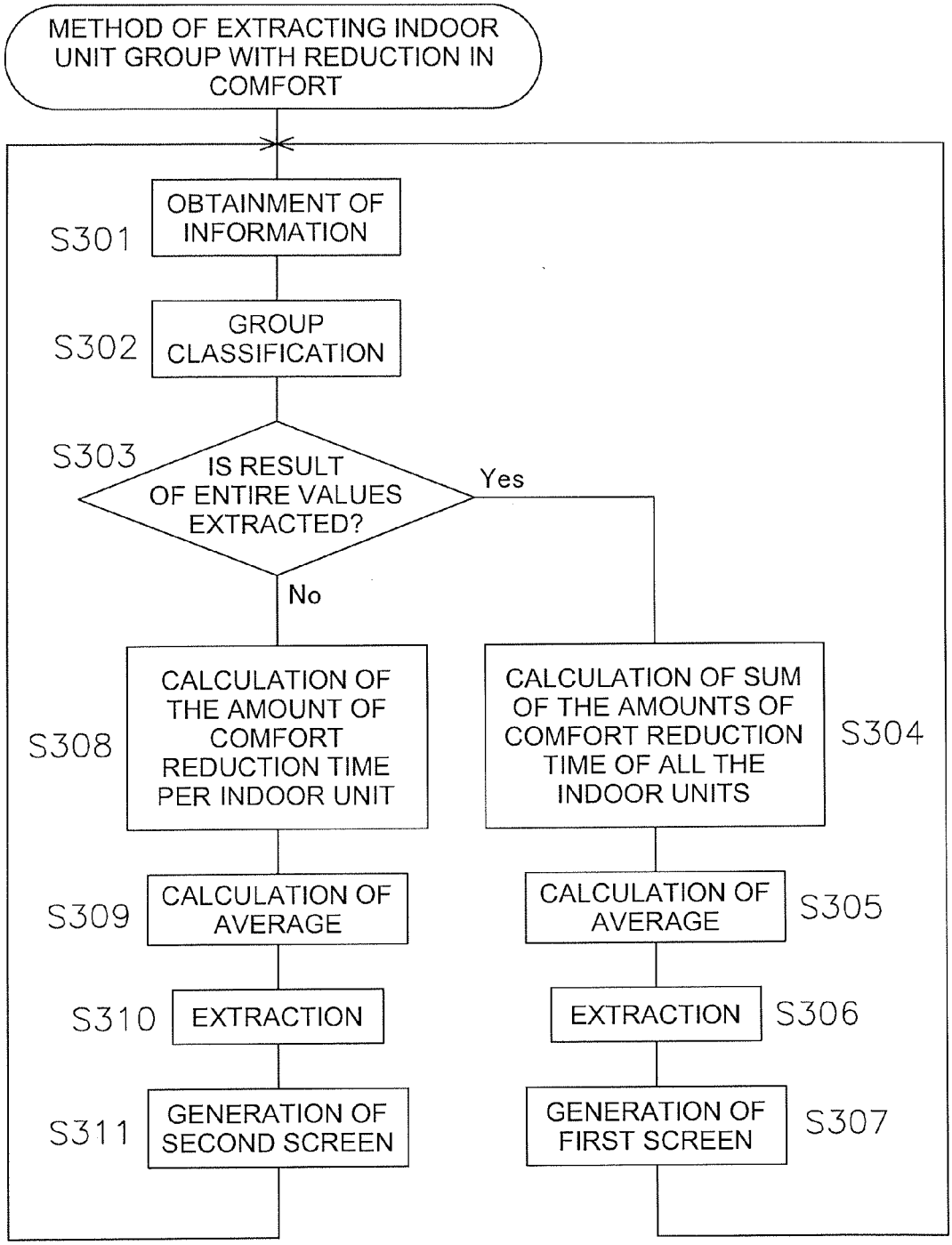
FIG. 7C is a flowchart representing a series of steps for extracting a result based on reduction in comfort.

Next, a method of extracting an indoor unit group based on the perspective of reduction in comfort will be explained with reference to FIG. 7C. In Step S301, the information obtaining section 35*a* obtains operational data. In subsequent Step S302, the indoor units 12*aa*-12*ad*, 12*ba*-12*bd*, 12*ca*-12*cd* and the like are classified into the indoor unit groups 15*a*, 15*b* and 15*c* based on the information stored in the classification information storage area 34*b*. Next, it is determined in Step S303 whether or not an extracted result of entire values should be displayed. The processing proceeds to Step S304 if the extracted result of the entire values is determined to be displayed in Step S303. In Step S304, sum of the amounts of comfort reduction time (i.e., entire value) is calculated for the indoor units 12*aa*-12*ad*, 12*ba*-12*bd*, 12*ca*-12*cd* and the like belonging to each of the indoor unit groups 15*a*, 15*b* and 15*c*. In subsequent Step S305, average of the entire values is calculated. In Step S306, one or more groups having an entire value greater than the calculated average is extracted from all the indoor unit groups. In Step S307, the extracted result is displayed on the first screen generated by the screen generating section 35*e*. On the other hand, the processing proceeds to Step S308 if the extracted result of the entire values is determined not to be displayed in the aforementioned Step S303, in other words, if an extracted result of the individual values is displayed. In Step S308, the amount of comfort reduction time per unit (i.e., individual value) is calculated for the indoor units 12*aa*-12*ad*, 12*ba*-12*bd*, 12*ca*-12*cd* and the like belonging to each of the indoor unit groups 15*a*, 15*b* and 15*c*. In subsequent Step S309, average of the individual values is calculated. In Step S310, one or more groups to which indoor units having an individual value greater than the calculated average belong are extracted from all the indoor unit groups. In Step S311, the extracted result is subsequently displayed on the second screen generated by the screen generating section 35*e*.

<Extraction Screen>

In a chart 701*a* of the first screen, sum of the amounts of comfort reduction time (i.e., entire value) is plotted with respect to each of the indoor unit groups extracted by the extracting section 35*c*. In the chart 701*a*, the vertical axis represents sum of the amounts of comfort reduction time (i.e., entire value) of the indoor units belonging to each of the indoor unit groups, whereas the horizontal axis represents average per day in a measured term of the entire value. In a chart 701*b* on the second screen, the amount of comfort reduction time per unit (i.e., individual value) is plotted with respect to each of the indoor unit groups extracted by the extracting section 35*c*. In the chart 701*b*, the vertical axis represents the amount of comfort reduction time per unit (i.e., individual value) of the indoor units belonging to each of the extracted indoor unit groups, whereas the horizontal axis represents average per day in a measured term of the entire value. The extracted results are listed in a descending order of magnitude of reduction in comfort in a table 702*a* on the first screen and a table 702*b* on the second screen. When a given group is selected from the extracted indoor unit groups (buildings in the present exemplary embodiment) listed in the tables 702*a* and 702*b*, a corresponding legend is configured to perform a predetermine action (e.g., blinking) in the charts 701*a* and 701*b*, similarly to the screens displaying the extraction results of heavy power consumption and a long time operation (see FIGS. 5A, 5B, 6A and 6B).

<Features>

(1) As exemplified in the present exemplary embodiment, the controllers 20*a*, 20*b* and 20*c* are installed on a one-to-one basis in the plural buildings 50*a*, 50*b* and 50*c* located in a single management region 1. Each administrator, who is in charge of each building, executes control and operational condition management of the indoor units 12*aa*-12*ad*, 12*ba*-12*bd*, 12*ca*-12*cd* and the like installed in each building using a corresponding one of the controllers 20*a*, 20*b* and 20*c*. However, it is required to check all the controllers 20*a*, 20*b* and 20*c* for checking the operational conditions of all the indoor units 12*aa*-12*ad*, 12*ba*-12*bd*, 12*ca*-12*cd* and the like in the management region 1 and entirely assessing the indoor units installed in the respective buildings. In this case, only checking all the operational data will be complicated and bothersome if the plural buildings 50*a*, 50*b* and 50*c* are located in a wide range of the region or there exist a large number of buildings. According to the group management apparatus 30 of the present exemplary embodiment, however, it is possible to efficiently assess the operational conditions of a large number of facility equipments installed in a plurality of buildings.

(2) Further, the group management apparatus 30 of the present exemplary embodiment is designed to extract one or more groups having a value greater than a threshold value from the indoor unit groups based on a plurality of assessment perspectives. A threshold value is herein set for each of the assessment perspectives, and the indoor unit group having a value greater than the threshold value is determined to have any kind of trouble. It is thereby possible to easily specify an indoor unit group requiring countermeasure against the trouble within the management region 1. In other words, it is possible to reduce time and effort to be spent for specifying an indoor unit group with a trouble. Further, one or more indoor unit groups are extracted based on a plurality of assessment perspectives. Therefore, the supervisory administrator is allowed to consider a solution by referring to extracted results depending on purposes.

(3) Further, the group management apparatus 30 of the present exemplary embodiment can assess the indoor unit groups 15*a*, 15*b* and 15*c* based on entire values and individual values as well as a plurality of the assessment perspectives. Specifically, one or more groups with a relatively serious trouble are extracted from the indoor unit groups based on sum of values (i.e., entire value) of the indoor units 12*aa*-12*ad*, 12*ba*-12*bd*, 12*ca*-12*cd* and the like belonging to each of the indoor unit groups 15*a*, 15*b* and 15*c* and a value per unit (i.e., individual value) of the indoor units 12*aa*-12*ad*, 12*ba*-12*bd*, 12*ca*-12*cd* and the like belonging to each of the indoor unit groups 15*a*, 15*b* and 15*c*. When given information cannot be determined only by checking the first screen of the result extracted based on the entire values, the information can be determined using the second screen of the result extracted based on the individual values. In the chart 503*a* of FIG. 5A, for instance, it is possible to determine that power consumptions of A and C are both large. In the chart 503*b* of FIG. 5B, troubles are more serious as plotted data are deviated from a baseline value (i.e., broken line 506*b*). It is accordingly possible to determine that a trouble is more serious in A than in C (A>C).

(4) Further, the group management apparatus 30 of the present exemplary embodiment is configured to manage a large number of indoor units 12*aa*-12*ad*, 12*ba*-12*bd*, 12*ca*-12*cd* and the like as a plurality of indoor unit groups 15*a*, 15*b* and 15*c*. Specifically, the present exemplary embodiment has explained a case that the indoor units 12*aa*-12*ad*, 12*ba*-12*bd*, 12*ca*-12*cd* and the like, belonging to the respective buildings 50*a*, 50*b*, 50*c*, are classified into the indoor unit groups 15*a*, 15*b* and 15*c*. However, the indoor units may be classified into another groups based on user's preference. For example, a single or plurality of indoor unit groups may be set to be scattered within each of the buildings 50*a*, 50*b* and 50*c*. Specifically, it is possible to classify indoor units installed in areas of the same category (e.g., all corridors, all bathrooms, all parlors, etc.) in each of the buildings 50*a*, 50*b* and 50*c* as a single indoor unit group. Accordingly, it is possible to more flexibly manage a large number of indoor units 12*aa*-12*ad*, 12*ba*-12*bd*, 12*ca*-12*cd* and the like within the system.

(5) Further, the group management apparatus 30 of the present exemplary embodiment is configured to extract one or more energy-saving applicable indoor units from the indoor units 12*aa*-12*ad*, 12*ba*-12*bd*, 12*ca*-12*cd* and the like in consideration of air conditioning performances thereof. Therefore, it is possible to accurately specify one or more indoor unit groups with a trouble.

<Modifications>

(1) The group management apparatus 30 of the aforementioned exemplary embodiment is configured to extract one or more groups having a value greater than a threshold value from the indoor unit groups 15*a*, 15*b* and 15*c* based on the individual values and the entire values. However, the group management apparatus 30 may be designed to extract one or more highly prioritized areas (one or more indoor unit groups) based on both the result of the entire values and the result of the individual values. As illustrated in FIG. 8, for instance, a trouble level may be designed to be calculated based on both the result of the entire values and the result of the individual values, and a given area having a small trouble level may be designed to be determined as a highly prioritized area (indoor unit group). In FIG. 8, a result of an entire value (i.e., rank) is provided with a weight coefficient (e.g., a weight coefficient of an entire value=0.5) and similarly a result of an individual value (i.e., rank) is provided with a weight coefficient (e.g., a weight coefficient of an individual value=0.5). A trouble level is calculated by adding a value obtained by multiplying the rank of the entire value with the corresponding weight coefficient and a value obtained by multiplying the rank of the individual value with the corresponding weight coefficient (i.e., a trouble level=0.5×(a rank of an entire value)+0.5×(a rank of an individual value)).

Figure 9:
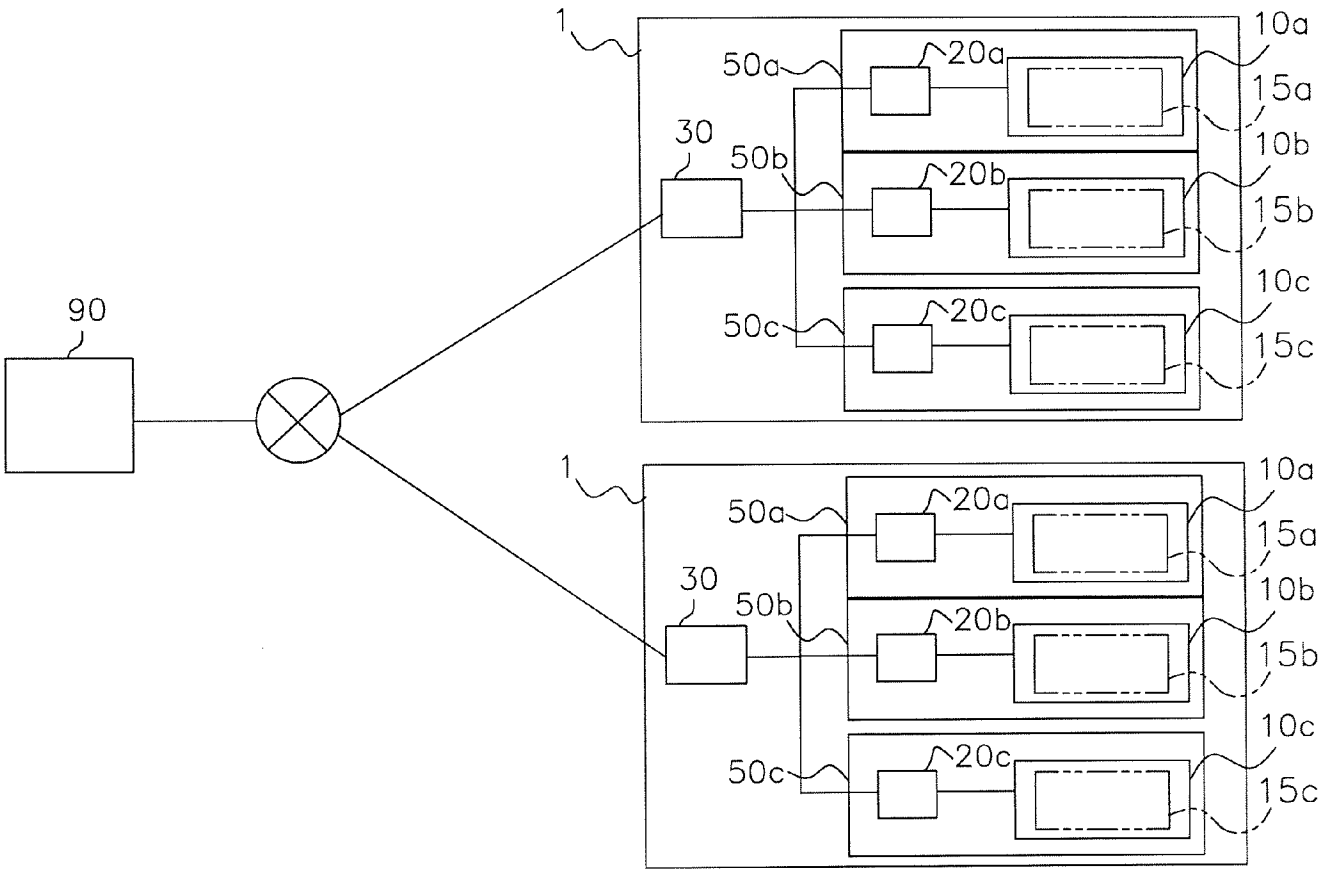
FIG. 9 is a diagram illustrating a group management system according to Modification (2) of the exemplary embodiment.

(2) In the aforementioned exemplary embodiment, the indoor units 12*aa*-12*ad*, 12*ba*-12*bd*, 12*ca*-12*cd* and the like are managed using the single group management apparatus 30 within a single management region. As illustrated in FIG. 9, in contrast, a remote management server 90 may be connected to a plurality of group management apparatuses 30 installed in the respective properties 1. Accordingly, a variety of perspectives, including heavy power consumption, long time operation, and reduction in comfort, can be assessed for the indoor units 12*aa*-12*ad*, 12*ba*-12*bd*, 12*ca*-12*cd* and the like by comparing information of a plurality of properties owned by different owners.

(3) In the aforementioned exemplary embodiment, the thermo-on time of the indoor units 12*aa*-12*ad*, 12*ba*-12*bd*, 12*ca*-12*cd* and the like is set as the operational time. However, a period of time during operation of the indoor units 12*aa*-12*ad*, 12*ba*-12*bd*, 12*ca*-12*cd* and the like may be set as the operational time. In this case, a period of time when the indoor units 12*aa*-12*ad*, 12*ba*-12*bd*, 12*ca*-12*cd* and the like are set in the power-on state is determined as the operational time. Further, a period of time when only a fan is operated is also considered as the operational time.

(4) In the aforementioned exemplary embodiment, conditions are determined with respect to the entire values of the indoor unit groups using "average per day". However, "total amount in a term" may be used instead of "average per day".

(5) In the aforementioned exemplary embodiment, one or more groups are extracted from all the indoor unit groups based on the respective perspectives of "long time operation" and "reduction in comfort" using average of the amount of occurrence days with a long time operation or average of the amount of occurrence days with reduction in comfort as a baseline value. However, a given indoor unit group may be designed to be extracted when a long time operation occurs therein even in a day or reduction in comfort occurs therein even for an hour.

(6) In the aforementioned exemplary embodiment, "heavy power consumption" is determined using power consumption values that the horsepower correction is conducted by the performance determining section 35*b*. However, a user may be allowed to arbitrarily determine whether or not horsepower correction should be conducted for the power consumption values.

<Other Exemplary Embodiment>

An exemplary embodiment of the present invention has been explained above based on the figures. However, specific configurations of the present invention are not limited to the aforementioned exemplary embodiment and a variety of changes can be made thereto without departing from the scope of the present invention.

INDUSTRIAL APPLICABILITY

The present invention is useful as a group management apparatus or a group management system for efficiently assessing the operational conditions of a large number of air conditioning facilities installed in a plurality of buildings.

What is claimed is:

1. A group management apparatus configured to manage a plurality of air conditioning facilities installed in a plurality of buildings as a plurality of groups, the group management apparatus comprising:

an obtaining section configured to obtain operational data of the air conditioning facilities through a plurality of control units disposed in the buildings on a one-to-one basis, the control units being configured to control the air conditioning facilities within the buildings;

an extracting section configured to extract one or more groups satisfying predetermined conditions from the groups based on a plurality of assessment perspectives, and a screen generating section configured to generate screens displaying a result extracted by the extracting section, the extracting section being further configured to extract said one or more groups satisfying the predetermined conditions from the groups based on at least one of a result of comparing an individual operational data of the air conditioning facilities belonging to one of the groups with an individual operational data of the air conditioning facilities belonging to another one of the groups, and a result of comparing a group operational data of one of the groups used as an entire operational data of the air conditioning facilities belonging to the one of the groups with a group operational data of another one of the groups, the screen generating section being configured to generate the screens showing the result in an order of the magnitude of trouble with respect to the plurality of assessment perspectives.

2. The group management apparatus according to claim 1, wherein the assessment perspectives include at least one of energy consumption, time operation, and reduction in comfort.

3. The group management apparatus according to claim 1, wherein the screen generating section is configured to generate a first screen and a second screen, the first screen displaying a first result as the result extracted based on the result of comparing between the individual operational data, and the second screen displaying a second result as the result extracted based on the result of comparing between the group operational data.

4. The group management apparatus according to claim 3, further comprising:

an operational data storage area configured to store the operational data of the air conditioning facilities; and a threshold value setting section configured to set a threshold value based on the operational data stored in the operational data storage area, the operational data and the threshold value being comparably displayed on respective screens on an operational time basis.

5. The group management apparatus according to claim 3, wherein the screen generating section is further configured to generate a single screen switchably displaying one or more groups extracted based on the respective assessment perspectives.

6. A group management apparatus configured to manage a plurality of air conditioning facilities installed in a plurality of buildings as a plurality of groups, the group management apparatus comprising:

an obtaining section configured to obtain operational data of the air conditioning facilities through a plurality of control units disposed in the buildings on a one-to-one basis, the control units being configured to control the air conditioning facilities within the buildings; and an extracting section configured to extract one or more groups satisfying predetermined conditions from the groups based on a plurality of assessment perspectives, the extracting section being further configured to extract said one or more groups satisfying the predetermined conditions from the groups based on at least one of a result of comparing an individual operational data of the air conditioning facilities belonging to one of the groups with an individual operational data of the air conditioning facilities belonging to another one of the groups, and a result of comparing a group operational data of one of the groups used as an entire operational data of the air conditioning facilities belonging to the one of the groups with a group operational data of another one of the groups, said one or more groups satisfying the predetermined conditions being one or more of the air conditioning facilities having a trouble regarding one of the assessment perspectives, and the extracting section being further configured to extract said one or more groups having a trouble based on both the result of comparing between the individual operational data and the result of comparing between the group operational data.

7. The group management apparatus according to claim 6, further comprising:

a screen generating section configured to generate screens displaying a result extracted by the extracting section, the screen generating section being configured to generate a first screen and a second screen, the first screen displaying a first result as the result extracted based on the result of comparing between the individual operational data, and the second screen displaying a second result as the result extracted based on the result of comparing between the group operational data.

8. The group management apparatus according to claim 7, further comprising:

an operational data storage area configured to store the operational data of the air conditioning facilities; and a threshold value setting section configured to set a threshold value based on the operational data stored in the operational data storage area, the operational data and the threshold value being comparably displayed on respective screens on an operational time basis.

9. The group management apparatus according to claim 7, wherein the screen generating section is further configured to generate a single screen switchably displaying one or more groups extracted based on the respective assessment perspectives.

10. The group management apparatus according to claim 6, wherein the assessment perspectives include at least one of energy consumption, time operation, and reduction in comfort.

11. A group management system configured to manage a plurality of air conditioning facilities respectively installed in a plurality of buildings as a plurality of groups, the group management system comprising:

a plurality of control units disposed in the buildings on a one-to-one basis, the control units being configured to control the air conditioning facilities within the buildings; and a group management apparatus connected to the control units, the group management apparatus being configured to manage the air conditioning facilities as a plurality of groups through the control units, the group management apparatus including an obtaining section configured to obtain operational data of the air conditioning facilities;

an extracting section configured to extract one or more groups satisfying predetermined conditions from the groups respectively including the air conditioning facilities based on a plurality of assessment perspectives; and a screen generating section configured to generate screens displaying a result extracted by the extracting section, the extracting section being further configured to extract said one or more groups satisfying the predetermined conditions from the groups based on at least one of a result of comparing an individual operational data of the air conditioning facilities belonging to one of the groups with an individual operational data of the air conditioning facilities belonging to another one of the groups, and a result of comparing a group operational data of one of the groups used as an entire operational data of the air conditioning facilities belonging to the one of the groups with a group operational data of another one of the groups, the screen generating section being configured to generate the screens showing the result in an order of the magnitude of trouble with respect to the plurality of assessment perspectives.

* * * * *